US010607459B1

(12) United States Patent
Sanchez et al.

(10) Patent No.: US 10,607,459 B1
(45) Date of Patent: Mar. 31, 2020

(54) DEVICE ARRANGEMENT AND ACTION ASSIGNMENT

(71) Applicant: Amazon Technologies, Inc., Seattle, WA (US)

(72) Inventors: Juan Antonio Sanchez, Seattle, WA (US); Michael John Guarniere, Redondo Beach, CA (US)

(73) Assignee: Amazon Technologies, Inc., Seattle, WA (US)

( * ) Notice: Subject to any disclaimer, the term of this patent is extended or adjusted under 35 U.S.C. 154(b) by 31 days.

(21) Appl. No.: 15/792,512

(22) Filed: Oct. 24, 2017

(51) Int. Cl.
*G08C 17/02* (2006.01)
*G08B 5/36* (2006.01)

(52) U.S. Cl.
CPC ..... *G08B 5/36* (2013.01); *G08C 17/02* (2013.01); *G08C 2201/20* (2013.01); *G08C 2201/92* (2013.01)

(58) Field of Classification Search
CPC ..... G08B 5/36; G08C 17/02; G08C 2201/20; G08C 2201/92
See application file for complete search history.

(56) References Cited

U.S. PATENT DOCUMENTS 5,948,084 A * 9/1999 Ha ..... G06F 13/385 710/73
6,602,001 B1 * 8/2003 Hatano ..... G08C 19/28 340/12.53
9,176,538 B2 * 11/2015 Boulanger ..... G06F 1/1684
2004/0140998 A1 * 7/2004 Gravina ..... G09B 5/06 715/716
2007/0247338 A1 * 10/2007 Marchetto ..... G08C 17/00 341/22
2012/0178371 A1 * 7/2012 Patel ..... G08C 17/00 455/41.3
2018/0152658 A1 * 5/2018 Adams ..... H04N 5/4403

* cited by examiner

*Primary Examiner* — Thomas D Alunkal
(74) *Attorney, Agent, or Firm* — Lee & Hayes, P.C.

(57) ABSTRACT

Systems and methods for button arrangement and action assignment are disclosed. One or more buttons and, in examples, a connector may be arranged in various ways. The buttons may be associated with one or more actions to be performed by the buttons and/or a device associated with the buttons based at least in part on the arrangement of the buttons. The buttons may be interchangeable and may allow for performance of various functionalities associated with multiple electronic devices.

20 Claims, 14 Drawing Sheets

DEVICE ARRANGEMENT AND ACTION ASSIGNMENT

BACKGROUND

Remote controls, keyboards, and other devices have buttons. Those buttons are physically fixed, typically are not configured to transmit data, and are associated with a single command. Described herein are improvements in technology that will help, among other things, to provide technology for improving these and other types of devices.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DETAILED DESCRIPTION

Figure 1:
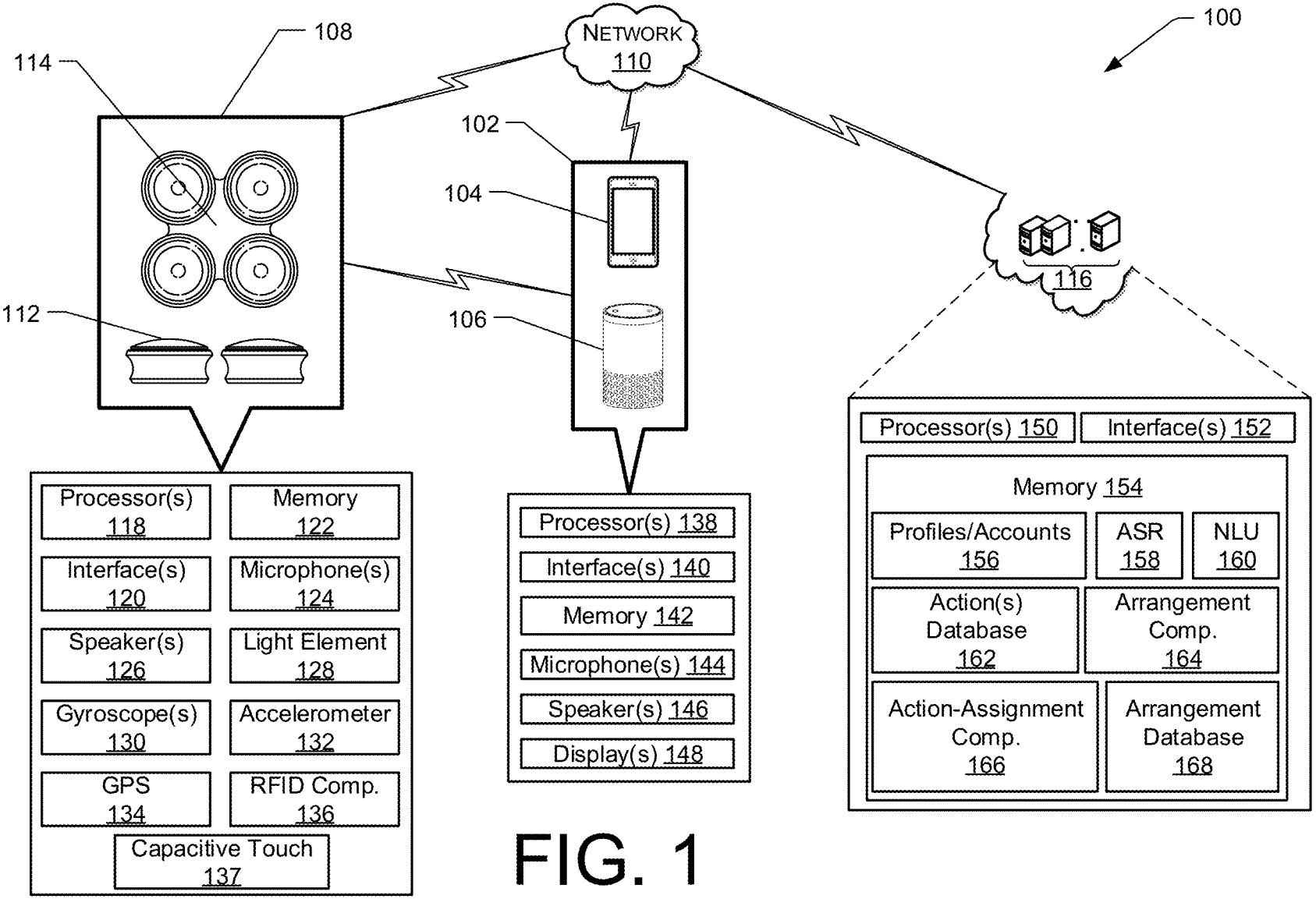
FIG. 1 illustrates a schematic diagram of an example environment for device arrangement and action assignment.

Systems and methods for device arrangement and action assignment are described herein. Take, for example, a user that has one, two, or more stand-alone devices, also described herein as buttons, along with, in examples, a connector that may allow the buttons to be removeably coupled to and/or placed upon the connector. While the buttons and/or connectors may take on a number of configurations, for illustration purposes, the buttons may be handheld, circular buttons and the connector may include slots sized to receive the buttons. A user of the buttons may desire to use the buttons for multiple purposes, such as for remote control of electronic devices in a home, such as televisions, lighting, and/or video games. Other purposes may include playing a game, such as Simon Says or Jeopardy, and/or for educational lessons. Typically, to control a television a first remote control with buttons is required; to control lighting another remote control is required; to play a video game another controller is required; to play a first game a game-specific button is provided; and to play a second game another game-specific button is provided. As such, buttons used to cause other devices to perform specific actions are typically fixed, are not interchangeable, and are configured to cause devices to perform a single action, such as decreasing volume, turning a light on, or causing a character to, for example, jump on a video game. Those buttons cannot be configured to perform other actions such as increasing volume, turning a light off, or causing a character to move on a video game.

To address these shortcomings, the present disclosure describes example systems and methods for button arrangement and action assignment for interchangeable buttons. As used herein, "interchangeable" means a button may be used for multiple actions and/or a button may be removeably coupled to multiple portions of a connector and/or to other buttons. The buttons may be stand-alone buttons that may be configured to communicate with each other and/or with a connector and/or with another device such as a mobile device or a communal device. Take, for example, a user that desires to use the buttons to play a game of Jeopardy with two friends. An application corresponding to the game may be accessible by the mobile device and/or the communal device associated with the user, the user's profile, and/or the user's account. Upon receiving an indication that the user desires to utilize the buttons to play Jeopardy, one or more operations may be performed to arrange the buttons for game play and assign the buttons one or more actions that, when the buttons are actuated, are performed by the buttons, the mobile device, and/or the communal device. For example, a user may say the phrase "Alexa, let's play Jeopardy" to the communal device. One or more microphones of the communal device may capture audio representing the user's speech and generate corresponding audio data that may be sent to a remote system for processing. The remote system may determine an intent associated with the user speech, here the intent being to play Jeopardy.

The remote system may determine that one or more buttons, here three buttons for example, will need to be arranged and assigned actions based on the intent to play Jeopardy. The remote system may send data representing arrangement instructions to the communal device. The arrangement instructions may include directing the user to physically position each button in front of a user and pushing the buttons in a prescribed order to associate each player with each button. The instructions may be presented visually, such as when the device associated with the buttons includes a display, and/or audibly, such as when the device is a voice-assistant device. Signals received from the buttons may indicate that the buttons have been arranged according to the instructions and that the users are ready to play Jeopardy. Additionally, the remote system may assign an action to each of the buttons based on the arrangement of the buttons. For example, the remote system may assign a first "buzz-in" action to a first button associated with a first player, a second buzz-in action to a second button associated with a second player, and a third buzz-in action to a third button associated with a third player. Thereafter, the mobile device and/or communal device may initiate a game of Jeopardy and the players may actuate their buttons to buzz-in to provide a question for the presented Jeopardy answer. In this Jeopardy-game example, the first button to be actuated may cause a lighting element associated with the first button to illuminate, indicating that the user corresponding to that button has buzzed in first and may provide the question. The user may speaker the question and audio representing the question may be captured by the communal device. Corresponding audio data may be generated and sent to the remote system for processing.

One or more of the users may then desire to use one or more of the buttons for a different purpose, such controlling functionality of a television. In this example, the user may removeably couple one or more of the buttons to a connector, such as a carrying case, mat, or other slotted component. One or more of the buttons, and/or the connector, and/or the user may provide an indication that the buttons are to now be used to control functionality of a television. Based at least in part this indication, the buttons may be rearranged and the actions associated with those buttons reassigned to enable television remote control functionality. In examples, the connector may be a "smart device" with multiple slots sized to receive the buttons. When the buttons are placed in the slots, the smart device may associate the buttons with the slots and send data representing the button arrangement to the remote system. In other examples, the connector may simply include multiple slots sized to receive the buttons but may not have arrangement and/or communication means with the buttons and/or the remote system. In these examples, signals from the buttons may be received by the mobile device and/or the communal device and corresponding data may be sent to the remote system for button arrangement and assignment.

In the example of a connector with arrangement and communication means, the placement of a particular button in a particular slot of the connector may not be required. Instead, any of the buttons may be removeably coupled to a particular slot and the connector may associate that button with the slot and relay that association to the remote system for button action assignment. In the example of a connector without arrangement or communication means, the mobile device and/or the communal device may provide instructions for arrangement of the buttons, such as placing a particular button in a particular slot and/or actuating a button that has been placed in a particular slot of the connector. In these examples, the buttons may send actuation signals to the mobile device and/or the communal device for arrangement of the buttons.

Additionally, or alternatively, one or more other button arrangement and/or action assignment options may be utilized. For example, the buttons may be arranged based at least in part on an amount of time that has elapsed since one or more of the buttons were utilized. In other examples, the buttons may be arranged based at least in part on gyroscopic and/or accelerometer data received from one or more of the buttons. In other examples, the buttons may be arranged based at least in part on the application that is being accessed and/or utilized by the buttons and/or devices associated with the buttons. In other examples, the buttons may be arranged based at least in part on magnetic fields generated by the buttons. In other examples, the buttons may be arranged based at least in part on light elements associated with the buttons. In other examples, the buttons may be arranged based at least in part on a location of the buttons within an environment, locations of the buttons with respect to each other, and/or locations of the buttons with respect to a connector. In other examples, the buttons may be arranged based at least in part on which slots of the buttons have received prongs from the connector. In other examples, the buttons may be arranged based at least in part on a user's selection of actions to be associated with the buttons.

The present disclosure provides an overall understanding of the principles of the structure, function, manufacture, and use of the systems and methods disclosed herein. One or more examples of the present disclosure are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

Additional details are described below with reference to several example embodiments.

FIG. 1 illustrates a schematic diagram of an example system 100 for device arrangement and action assignment. The system 100 may include, for example, one or more user devices 102. The user devices 102 may include personal devices 104, such as a mobile phone, and/or communal devices 106, such as voice-assistant devices. The user devices 102 may communicate directly and/or via a network 110 with one or more accessory devices 108. The accessory devices 108 may include one or more buttons 112 and/or one or more connectors 114 configured to couple to the buttons 112. The accessory devices 108 and/or the user devices 102 may communicate, via the network 110, with a remote system 116.

The buttons 112 may include, for example, a base and an actuatable portion that, when engaged by a user, causes a signal to be generated indicating that the button has been pushed or otherwise actuated. It should be understood that actuating the button is not limited to depressing the actuatable portion toward the base portion. Additionally, or alternatively, actuating the button may include a user or object making contact with the actuatable portion and/or the user or object being within a threshold proximity of the actuatable portion. It should also be understood that while the buttons 112 depicted in FIG. 1 are circular, other shapes and dimensions are included in this disclosure. Some of these button designs are described below with respect to FIGS. 2A-5.

The buttons 112 may include one or more components in addition to the actuatable portion. For example, the buttons 112 may include one or more processors 118, one or more network interfaces 120, memory 122, one or more microphones 124, one or more speakers 126, one or more light elements 128, one or more gyroscopes 130, one or more accelerometers 132, one or more global positioning system (GPS) components 134, one or more radio-frequency identification components 136, and/or one or more capacitive touch components 137. In examples, the buttons 112 may include only the base and actuatable portion and may not include any processors, memory, or communication means. In these examples, the connectors 114 may include processors, memory, and communication means to determine when a button 112 has been actuated. In other examples, the buttons 112 may include the processors 118, network interfaces 120, and memory 122 to provide a means for determining that the buttons 112 have been actuated and to provide a communication means with the user devices 102 and/or the remote system 116, but without the other components described above. In still other examples, the buttons 112 may include the processors 118, network interfaces 120, the memory 122, and one or more of the other components described above. In these examples, the buttons 112, in addition to being configured to determine when the buttons 112 have been actuated and communicate with the user devices 102 and/or the remote system 116, may additionally be configured to determine an arrangement of the buttons 112 with respect to each other, and/or with respect to the connectors 114, and/or with respect to the environment in which the buttons 112 are situated.

Additionally, or alternatively, the connectors 114 may include physical components that allow for the buttons 112 to be received by the connectors 114, such as via slots, grooves, prongs, magnetic attachment, and/or placement. In other examples, the connectors 114 may include the one or more processors 118, the one or more network interfaces 120, the memory 122, the one or more microphones 124, the one or more speakers 126, the one or more light elements 128, the one or more gyroscopes 130, the one or more accelerometers 132, the one or more global positioning system (GPS) components 134, and/or the one or more radio-frequency identification (RFID) components 136. These components may perform the same, similar, or different functions than the components of the buttons 112. The connectors 114 may be configured to each receive the buttons 112 such that the buttons 112 may be coupled to a first connector 114 and those same buttons 112 may be decoupled from the first connector 114 and coupled to the second connector 114.

The memory 122 of the accessory devices 108 may include instructions that, when executed by the one or more processors 118, may cause the one or more processors 118 to perform certain operations. For example, the operations may include determining when an actuatable portion of a button 112 has been actuated. The operations may additionally, or alternatively, include causing the light elements 128 of the buttons 112 and/or the connectors 114 to emit light. The operations may additionally, or alternatively, include generating gyroscopic data, accelerometer data, GPS data, and/or RFID data. The operations may additionally, or alternatively, include receiving information from the user devices 102 and/or the remote system 116 and/or sending information between the accessory devices 108 and/or from the accessory devices 108 to the user devices 102 and/or the remote system 116. The operations may additionally, or alternatively, include determining an arrangement of the buttons 112 with respect to each other, and/or with respect to the connectors 114, and/or with respect to an environment in which the buttons 112 and/or the connectors 114 are disposed.

The one or more microphones 124 of the accessory devices 108 may be configured to capture audio from an environment in which the accessory devices 108 are positioned. This audio may include, for example, user speech and/or sound produced by the actuatable portion of the buttons 112 and/or sound produced by the buttons 112 without actuation, such as sound in human-imperceptible frequency ranges. The one or more microphones 124 may generate audio data corresponding to the captured audio. The one or more speakers 126 of the accessory devices 108 may be configured to output audio corresponding to audio data received from other components of the accessory devices 108 and/or the user devices 102 and/or the remote system 116.

The one or more light elements 128 of the accessory devices 108 may be configured to emit light. For example, a light element 128 may be a component of a button 112 and may emit light when the button 112 is actuated. Additionally, or alternatively, the light element 128 may include LEDs positioned around a perimeter of the button 112 and configured to emit light based on the arrangement of the buttons 112 with respect to each other, and/or with respect to the connectors 114, and/or with respect to the user devices 102. The light elements 128 may also be utilized during arrangement of the buttons 112 as described in more detail below, such as during presentation of directions and/or instructions for button arrangement.

The one or more gyroscopes 130 may be configured to sense an orientation of the accessory devices 108. The gyroscopes 130 may communicate with the processors 118 to generate gyroscopic data, which may be utilized to determine if the orientation of a button 112 and/or a connector 114 has changed over a period of time and/or from the last time the button 112 and/or the connector 114 was utilized. The one or more accelerometers 132 may be configured to sense proper acceleration of the accessory devices 108. The accelerometers 132 may communicate with the processors 118 to generate acceleration data, which may be utilized to determine if the position of a button 112 and/or a connector 114 has changed over a period of time and/or from the last time the button 112 and/or the connector 114 was utilized. The one or more GPS components 134 may be configured to sense a physical positional change of the accessory device 108, and/or to provide positional data for determining a physical positional change of the accessory devices 108. The GPS components 134 may communicate with the processors 118 to generate GPS data, which may be utilized to determine if the position of a button 112 and/or a connector 114 has changed over time and/or from the last time the button 112 and/or the connector 114 was utilized.

The RFID components 136 may include an RFID tag or identifier, which may be disposed at least partially within the button 112, and an RFID scanning component, which may be disposed at least partially within the connector 114. The RFID components 136 may be utilized to determine where certain buttons 112 are located with respect to the connector 114. In further examples, the RFID components 136 may be utilized to determine where certain buttons 112 are located with respect to each other.

The capacitive touch components 137 may include elements that allow for capacitive sensing based at least in part on capacitive coupling. The capacitive touch components 137 may include one or more sensors that may be configured to detect and/or measure position, displacement, and/or proximity of an object to the buttons 112. An insulator may be coated with a conductive material and a voltage may be applied, resulting in a uniform electrostatic field. When a conductor, such as a human finger, touch the uncoated portion of the layer or another portion of the insulator, a capacitor may be formed, resulting in the generation of an electrical signal corresponding to the touch. The capacitive touch components 137 may be utilized to determine when a button 112 has been actuated, for example.

The user devices 102 may include one or more processors 138, one or more network interfaces 140, memory 142, one or more microphones 144, one or more speakers 146, and/or one or more displays 148. The user devices 102 may be configured to communicate with the accessory devices 108 via the network 110 and/or via direct communication means, such as via one or more Bluetooth protocols.

The one or more microphones 144 of the user devices 102 may be configured to capture audio from an environment in which the user devices 102 are positioned. This audio may include, for example, user speech and/or sound produced by the actuatable portion of the buttons 112 and/or sound produced by the buttons 112 without actuation, such as sound in human-imperceptible frequency ranges. The one or more microphones 144 may generate audio data corresponding to the captured audio. The one or more speakers 146 of the user devices 102 may be configured to output audio corresponding to audio data received from other components of the user devices 102 and/or the accessory devices 108 and/or the remote system 116. In examples, the user devices 102 may not include a display 148, such as when the user device 102 is a voice-assistant device. In other examples, such as when the user device 102 is a mobile phone, the user device 102 may include a display 148 that may be configured to visually present actions associated with the accessory devices 108 and/or applications that utilize the accessory devices 108.

The remote system 116 may include, for example, one or more processors 150, one or more network interfaces 152, and memory 154. The remote system 116 may communicate with the user devices 102 and/or the accessory devices 108 via the network 110.

As used herein, a processor, such as processor(s) 118, 138, and/or 150, may include multiple processors and/or a processor having multiple cores. Further, the processors may comprise one or more cores of different types. For example, the processors may include application processor units, graphic processing units, and so forth. In one implementation, the processor may comprise a microcontroller and/or a microprocessor. The processor(s) 118, 138, and/or 150 may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 118, 138, and/or 150 may possess its own local memory, which also may store program components, program data, and/or one or more operating systems.

The memory 122, 142, and/or 154 may include volatile and nonvolatile memory, removable and non-removable media implemented in any method or technology for storage of information, such as computer-readable instructions, data structures, program component, or other data. Such memory 122, 142, and/or 154 includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory 122, 142, and/or 154 may be implemented as computer-readable storage media ("CRSM"), which may be any available physical media accessible by the processor(s) 118, 138, and/or 150 to execute instructions stored on the memory 122, 142, and/or 154. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s).

Further, functional components may be stored in the respective memories, or the same functionality may alternatively be implemented in hardware, firmware, application specific integrated circuits, field programmable gate arrays, or as a system on a chip (SoC). In addition, while not illustrated, each respective memory, such as memory 122, 142, and/or 154, discussed herein may include at least one operating system (OS) component that is configured to manage hardware resource devices such as the network interface(s), the I/O devices of the respective apparatuses, and so forth, and provide various services to applications or components executing on the processors. Such OS component may implement a variant of the FreeBSD operating system as promulgated by the FreeBSD Project; other UNIX or UNIX-like variants; a variation of the Linux operating system as promulgated by Linus Torvalds; the FireOS operating system from Amazon.com Inc. of Seattle, Wash., USA; the Windows operating system from Microsoft Corporation of Redmond, Wash., USA; LynxOS as promulgated by Lynx Software Technologies, Inc. of San Jose, Calif.; Operating System Embedded (Enea OSE) as promulgated by ENEA AB of Sweden; and so forth.

The network interface(s) 120, 140, and/or 152 may enable communications between the components and/or devices shown in system 100 and/or with one or more other remote systems, as well as other networked devices. Such network interface(s) 120, 140, and/or 152 may include one or more network interface controllers (NICs) or other types of transceiver devices to send and receive communications over the network 110.

For instance, each of the network interface(s) 120, 140, and/or 152 may include a personal area network (PAN) component to enable communications over one or more short-range wireless communication channels. For instance, the PAN component may enable communications compliant with at least one of the following standards IEEE 802.15.4 (ZigBee), IEEE 802.15.1 (Bluetooth), IEEE 802.11 (WiFi), or any other PAN communication protocol. Furthermore, each of the network interface(s) 120, 140, and/or 152 may include a wide area network (WAN) component to enable communication over a wide area network.

In some instances, the remote system 116 may be local to an environment associated the user devices 102 and/or the accessory devices 108. For instance, the remote system 116 may be located within the user devices 102 and/or the accessory devices 108. In some instances, some or all of the functionality of the remote system 116 may be performed by one or more of the user devices 102 and/or the accessory devices 108.

The memory 154 of the remote system 116 may include computer-executable instructions, described below as components of the memory 154, that when executed by the one or more processors 150 may cause the one or more processors 150 to perform various operations. Exemplary components of the memory 154 of the remote system 116 may include a profile/accounts component 156, an automatic speech recognition (ASR) component 158, a natural language understanding (NLU) component 160, an actions database 162, an arrangement component 164, an action-assignment component 166, and/or a button arrangement database 168. Each of these exemplary components of the memory 154 are described below.

The user profiles/accounts component 156 may be configured to identify, determine, and/or generate associations between users, user profiles, user accounts, and/or devices. For example, one or more associations between buttons 112, between buttons 112 and connectors 114, between accessory devices 108 and user devices 102, among accessory devices 108, among user devices 102, and/or between accessory devices 108 and/or user devices 102 and user profiles and/or user accounts may be determined. The user profiles/accounts component 156 may additionally store information indicating one or more applications accessible to the accessory devices 108 and/or the user devices. It should be understood that the accessory devices 108 and/or the user devices 102 may be associated with one or more than one user profiles and/or user accounts. It should also be understood that that a user account may be associated with one or more than one user profile.

The ASR component 158 may be configured to receive audio data, which may represent human speech, and generate text data corresponding to the audio data. The text data may include words corresponding to the human speech. The NLU component 160 may be configured to determine one or more intents associated with the human speech based at least in part on the text data. The ASR component 158 and the NLU component 160 are described in more detail below with respect to FIG. 14. For purposes of illustration the ASR component 158 and the NLU component 160 may be utilized to determine one or more applications to be used in connection with the accessory devices 108 and/or to determine how to arrange the accessory devices 108.

The memory 154 may additionally include an actions database 162. The actions database 162 may store indications of one or more actions that may be performed in response to actuation of a button 112. Example actions may include, for example, controlling a television, controlling a video game, controlling lighting, interacting with a game, and/or teaching. The actions database 162 may include instructions that corresponds to the actions. The instructions may cause the actions to be performed by processors of the accessory devices 108, the user devices 102, and/or other devices being controlled by the buttons 112.

The memory 154 may additionally include an arrangement component 164, which may identify and/or determine an arrangement of the buttons 112 with respect to each other, with respect to a connector 114, and/or with respect to an environment in which the buttons 112 are situated. One or more methods of determining the arrangement of buttons 112 may be utilized. For example, when the connector 114 includes one or more sensors that determine which buttons 112 are received by the connector 114 and/or where those buttons 112 are positioned with respect to the connector 114, determining the arrangement of the buttons 112 may be based at least in part on data received from the connector 114 indicating the identity and positional placement of the buttons 112. This data may be utilized to identify and/or determine the button 112 arrangement. Additionally, or alternatively, data indicating button identity and positional placement with respect to the connector 114 and/or between buttons 112 may be determined based at least in part on sensors of the buttons 112 themselves. In these examples, the arrangement data may be sent from the buttons 112 to the remote system 116 to identify and/or determine the button arrangement. This communication may be via the user devices 102 and the network 110.

Additionally, or alternatively, data indicating that the buttons 112 have been actuated pursuant to instructions provided to a user may be utilized to determine button arrangement. For example, instruction data may be sent to the user device 102. The instruction data may represent one or more instructions to arrange the buttons 112. Presentation of the instructions, such as audible presentation in the case of a voice-assistant device 106 and/or visual presentation in the case of a mobile device 104, may be performed. The instructions may direct a user to arrange the buttons 112 in a particular order or location with respect to each other, with respect to the connector 114, and/or with respect to an environment in which the buttons 112 are situated. The instructions may direct the user to actuate the buttons 112 once the user has completed arrangement of the buttons 112 pursuant to the instructions. Signals representing actuation of the buttons 112 may be sent from the buttons 112 and/or the connector 114 to the user device 102 and/or the remote system 116 to confirm button arrangement.

Additionally, or alternatively, button arrangement may be based at least in part on an application being utilized and/or accessed by the user device 102. For example, a user may be utilizing a light-control application, or a video game application, or a teaching application. Each of these applications may be associated with different button functionalities and/or different button arrangements. This information may be utilized, at least in part, to determine the arrangement of the buttons 112.

Additionally, or alternatively, the button arrangement may be based at least in part on a magnetic field generated by the buttons 112. The use of magnetic fields to identify, determine, and/or cause button arrangements is described in more detail with respect to FIGS. 3A and 3B. Generally, the buttons 112 may include portions with positive magnetic fields and other portions with negative magnetic fields. The differing magnetic fields may be utilized to couple the buttons 112 together and/or couple the buttons 112 to the connector 114. The buttons 112 and/or the connector 114 may generate data indicating that the buttons 112 have been coupled together and/or that the buttons 112 have been coupled to the connector 114 at various positions with respect to the buttons 112 and/or the connector 114. In other examples, the magnetic fields associated with a button 112 may be dynamic. For example, one or more magnetic fields may be induced with respect to a first button 112 and a second button 112. The induced magnetic fields may cause the buttons 112, when brought into proximity to each other, to couple together in a specific arrangement.

Additionally, or alternatively, the button arrangement may be based at least in part on LEDs associated with the buttons 112. For example, the buttons 112 may include one or more LEDs, which may be disposed around a perimeter of some or all of the buttons 112. The LEDs may emit light, in examples, based at least in part on instruction data representing instructions to arrange the buttons 112. For example, a first LED of a first button 112 may be caused to emit first light while a second LED of a second button 112 may be caused to emit second light. An instruction may be presented to a user of the buttons 112 to orient the first button 112 and the second button 112 such that the first LED and the second LED are proximate to each other. Additional details regarding LED arrangement of the buttons 112 is described below with respect to FIG. 5.

Additionally, or alternatively, the button arrangement may be based at least in part on the position of the connector as detected by the buttons 112. For example, some or all of the buttons 112 may include one or more slots and/or prongs. The slots and/or prongs may include one or more sensors that may identify when a connector 114 and/or another button 112 comes into contact with the slots and/or prongs. The sensors may generate data indicating which slots and/or prongs of the buttons 112 are in contact with the connector and/or other button 112, which may indicate a position and/or orientation of a button 112 with respect to other buttons 112, the connector 114, and/or the environment in which the button 112 is situated. Additional details on utilizing button slots and/or prongs for button arrangement is described below with respect to FIGS. 4A and 4B.

Additionally, or alternatively, the button arrangement may be based at least in part on user-configurable settings associated with the buttons 112. For example, a user may provide input, such as audible input and/or touch input, such as when the user device 102 is a mobile phone 104, to the user device 102 that indicates an arrangement of the buttons 112. This input may be utilized to identify the button arrangement.

Additionally, or alternatively, the button arrangement may be based at least in part on a proximity of one or more buttons 112 to various user devices 102. For example, an environment may have multiple user devices 102 disposed therein, such as multiple voice-assistant devices 106. The button arrangement may be based at least in part on data indicating that one or more of the buttons 112 is in closer proximity to a first user device 102 than a second user device 102. This data may indicate that a first arrangement of the buttons 112 associated with the first user device 102 may be identified and/or determined. By way of example, a first user device 102 may be situated in a game room of a home while a second user device 102 may be situated in a kitchen of a home. Each of these user devices 102 may be associated with actions and/or tasks that are typically performed in the environments in which the user devices 102 are situated. This information may be utilized to determine that buttons 112 that are in close proximity to these user devices 102 may be utilized to perform the environment-specific actions and/or tasks. Identifying and/or determining the button arrangement may be based at least in part on this information.

Additionally, or alternatively, data from one or more of the microphones 124, the gyroscopes 130, the accelerometers 132, and/or the GPS components 134 may be utilized to identify and/or determine the arrangement of the buttons 112. For example, time-difference-of-arrival techniques may be utilized on audio data received from the microphones 124 to determine a position and/or orientation of each of the buttons 112. Additionally, or alternatively, gyroscopic data from the buttons 112 may be compared to determine an orientation of each of the buttons 112. Additionally, or alternatively, acceleration data from the buttons 112 may be compared to determine movements of the buttons 112 with respect to each other. Additionally, or alternatively, GPS components 134 may be utilized to determine positions of the buttons 112.

Additionally, or alternatively, the button arrangement component 164 may receive data from one or more cameras associated with the environment in which the buttons 112 are disposed. The cameras may capture images and generate corresponding image data that may be analyzed to identify the presence of the buttons 112 in the images. Additionally, or alternatively, the buttons 112 may emit light of a specific color, wavelength, and/or modulation and the cameras may capture images and compare corresponding image data to predetermined light color, wavelength, and/or modulation to identify the buttons 112 and/or determine their arrangement. The light may be in the visible spectrum and/or the non-visible spectrum, such as ultraviolet light and/or infrared light. Additionally, or alternatively, in examples where the buttons 112 include one or more sound emitting components, the buttons 112 may be caused to emit audible or non-audible sound, which may be captured by one or more microphones associated with the connectors 114 and/or user devices 102. Corresponding audio data may be generated and time-difference-of-arrival analysis may be performed to determine a location of the button 112 with respect to the microphones.

Additionally, or alternatively, the button arrangement component 164 may be utilized to determine when the arrangement of the buttons 112 has changed and/or remained static. For example, a threshold period of time may be utilized to determine if the arrangement of the buttons 112 has changed. In this example, when an amount of time since one or more of the buttons 112 were utilized is not more than the threshold period of time, it may be determined that the arrangement of the buttons 112 has not changed. In this case, rearrangement of the buttons 112 may not be performed. In examples, data representing a confirmation request may be sent to the user device 102 and/or the accessory device 108. The confirmation request may query the user to provide an indication that the button arrangement has not changed. In cases where the amount of time since the buttons 112 were utilized is more than the threshold period of time, it may be determined that the arrangement of the buttons 112 has likely changed. In these cases, rearrangement of the buttons 112 may be identified and/or determined using the arrangement component 164 and as described above. Additionally, or alternatively, the determination of whether the buttons 112 should be rearranged may be based at least in part on gyroscopic data from the gyroscope 130, accelerometer data from the accelerometer 132, GPS data from the GPS component 134, and/or RFID data from the RFID component 136. This data may provide an indication that the orientation, position, and/or placement of the buttons 112 have changed since the last time one or more of the buttons 112 was utilized.

The action-assignment component 166 of the memory 154 may be configured to identify and/or determine and/or assign one or more actions to the buttons 112. Assignment of the actions to the buttons 112 may be based at least in part on the button arrangement identified and/or determined by the arrangement component 164. Assignment of the actions to the buttons 112 may additionally, or alternatively, be based at least in part on user indications of which actions are to be performed when some or all of the buttons 112 are actuated. Assigning an action to a button 112 may include identifying the button 112 to which the action is to be assigned, identifying and/or determining an action to be performed by the button 112 and/or another device in response to actuation of the button 112, and associating the identified button 112 with the action such that, when a signal is received that the button 112 has been actuated, the memory 122, 142, and/or 154 causes the processors 118, 138, and/or 150 to perform the action and/or cause the action to be performed. Additionally, or alternatively, assignment of actions to the buttons 112 may be based at least in part on a mapping of locations of a connector 114 to the buttons 112 and to actions. For example, a particular location of the connector 114 may be predetermined to correspond to a given action. Based at least in part on receiving an indication that a button 112 has been coupled to the location of the connector 114, the action predetermined to correspond to that location may be assigned to the button 112 such that actuation of the button 112 causes a device or the button 112 to perform the action.

Associating actions with buttons 112 may additionally, or alternatively, be based at least in part on a proximity of one button 112 to another button 112. For example, a threshold distance may be predetermined, such as one centimeter, for example. In examples where the buttons 112 are more than the threshold distance from each other, the buttons 112 may be assigned one or more first actions. In other examples where the buttons 112 are within the threshold distance from each other, the buttons 112 may be assigned one or more second actions based at least in part on the buttons 112 being within the threshold distance from each other. Additionally, or alternatively, additional content and/or functionality of the application being using along with the buttons 112 may be unlocked or otherwise made available when the buttons 112 are within the threshold distance from each other.

By way of example, a button 112 may be assigned a "increase-volume" action. The button 112, when actuated, may generate and send a signal indicating that the button 112 has been actuated. The signal may be sent directly to a user device 102, via a network 110, and/or to the remote system 116 via the accessory devices 108 and/or the user devices 102. Based at least in part on the received data indicating that the button 112 has been actuated, the remote system 116 may send data to the button 112 and/or the user device 102 to perform the "increase-volume" action, which may cause, for example, a volume of audio output by a speaker associated with a television to increase.

The arrangement database 168 of the memory 154 may be configured to store arrangement data representing arrangements of the buttons 112 and/or the connectors 114. The arrangement database 168 may additionally be configured to store the action-assignment information identified and/or determined by the action-assignment component 166. This stored arrangement data and action-assignment information may be utilized for subsequent button usage after initial determination of button arrangement. The arrangement database 168 may store arrangement data in association with a given user device 102, user, user profile, and/or user account. This information may be utilized to determine common button arrangements used by the user and/or user device 102 and may inform subsequent button arrangement determinations and/or subsequent action assignments to buttons 112.

Figure 2B:
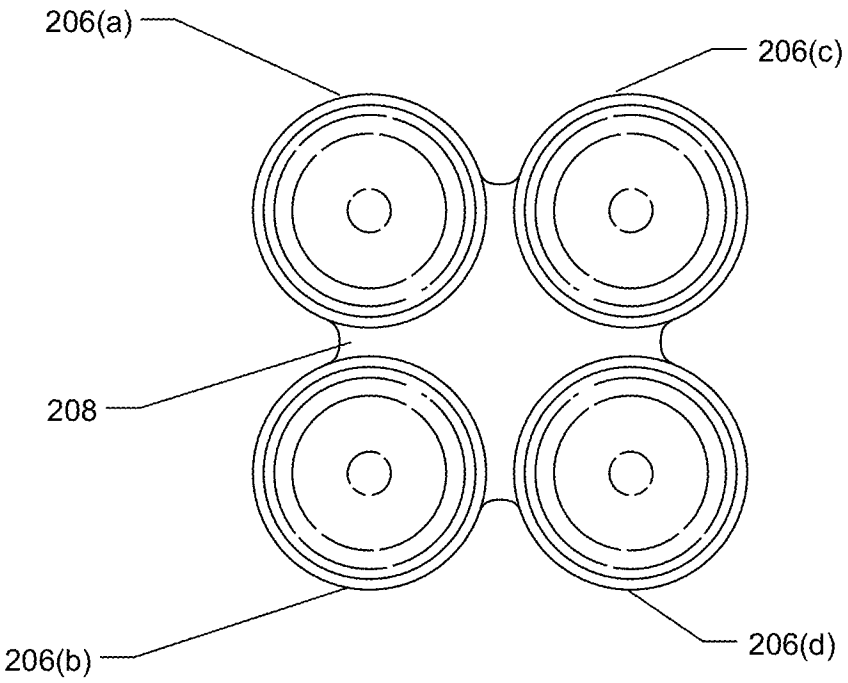
FIG. 2B illustrates four example devices similar to the button from FIG. 2A along with an example connector.
Figure 2A:
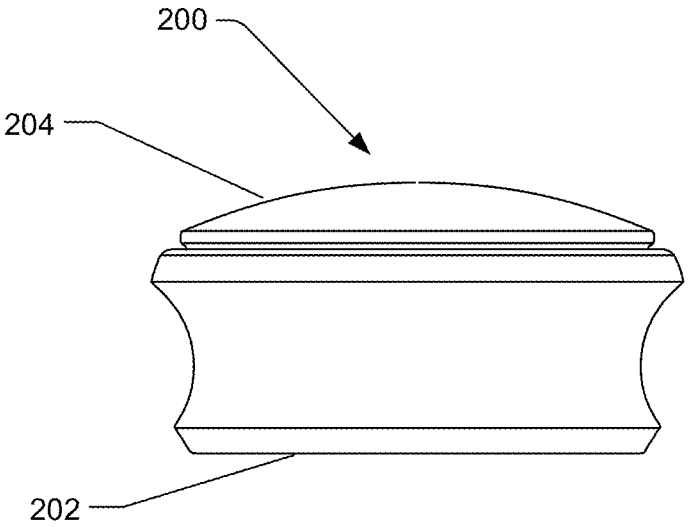
FIG. 2A illustrates an example arrangeable device to which one or more actions may be assigned.

FIG. 2A illustrates an example accessory device, described herein for example as a button 200. The button 200 may include a base portion 202 and an actuatable portion 204. The actuatable portion 204, when engaged by a user, may cause a signal to be generated indicating that the button 200 has been pushed or otherwise actuated. The button 200 may additionally, in examples, include one or more of the following: one or more processors; one or more network interfaces; memory; one or more microphones; one or more speakers; one or more light elements; one or more gyroscopes; one or more accelerometers; one or more global positioning system (GPS) components; and/or one or more radio-frequency identification components. In examples, the components of the button 200 may be configured to send and receive data associated with actuation of the button 200.

The design of the button 200 may vary. As shown in FIG. 2A, the button 200 may be circular in shape and/or may have one or more indents, which may allow for easy handling and use of the button. Other shapes are included in this disclosure. For example, the button may have a square shape, a rectangular shape, a conical shape, or may be shaped to resemble another object. The size of the button 200 may also vary. The buttons 200 may have uniform shape and/or size, and/or the buttons 200 may have varying shapes and/or sizes.

FIG. 2B illustrates four example buttons 206(*a*)-(*d*) similar to the button 200 from FIG. 2A along with an example connector 208. The buttons 206(*a*)-(*d*) may include some or all of the components of button 200 as described with respect to FIG. 2A. The connector 208 may be sized to receive one or more of the buttons 206(*a*)-(*d*). In examples, the connector 208 may not include any electronic components and may be utilized as a means of holding the buttons 206(*a*)-(*d*). In other examples, the connector 208 may include processors, network interfaces, memory, microphones, speakers, displays, and/or lighting elements. In these examples, the connector 208 may be configured to receive information from the buttons 206(*a*)-(*d*) and/or a user device and/or a remote system. The connector 208 may also be configured to send information to the buttons 206 (*a*)-(*d*) and/or a user device and/or a remote system.

The shape of the connector 208 may vary and may be dependent on the actions to be performed based on actuation of the buttons. For example, a video game application may be associated with a connector 208 having various portions and/or slots for receipt of buttons 206(*a*)-(*d*) positioned for playing the video game. By way of further example, a mat that may be utilized for teaching lessons may be configured to allow the buttons 206(*a*)-(*d*) to be placed upon the mat at various locations to indicate user interaction with the teaching application. Additionally, arrangements may be generated by third-party developers along with development of applications utilized by the buttons 206(*a*)-(*d*) and/or a user device associated with the buttons 206(*a*)-(*d*).

Figure 3A:
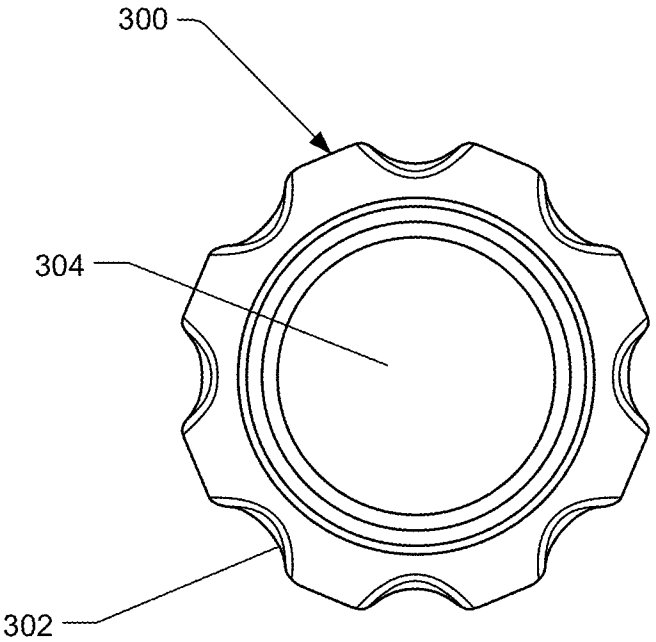
FIG. 3A illustrates another example arrangeable devices to which one or more actions may be assigned.

FIG. 3A illustrates another example button 300 as described herein. The button 300 may have the same or similar components as the button 200 described with respect to FIG. 2A. For example, the button 300 may have a base portion 302 and an actuatable portion 304. Other components of button 300 may include one or more of the following: one or more processors; one or more network interfaces; memory; one or more microphones; one or more speakers; one or more light elements; one or more gyroscopes; one or more accelerometers; one or more global positioning system (GPS) components; and/or one or more radio-frequency identification components. In examples, the components of the button 300 may be configured to send and receive data associated with actuation of the button 300. As shown in FIG. 3A, the shape of the base portion 302 of the button 300 may differ from the base portion 202 of the button 200 from FIG. 2A. Here, the base portion 302 may be shaped like a gear with peaks and valleys running along a perimeter of the base portion 302.

Figure 3B:
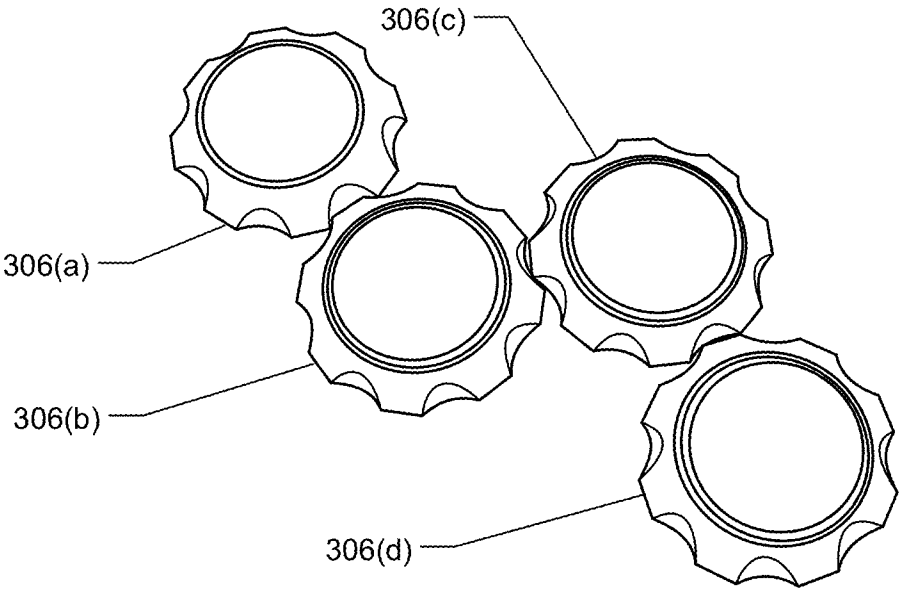
FIG. 3B illustrates four example devices similar to the button from FIG. 3A.

FIG. 3B illustrates four example buttons 306(*a*)-(*d*) similar to the button 300 from FIG. 3A. The gear-like design of a base portion of the buttons 306(*a*)-(*d*) may allow for the buttons 306(*a*)-(*d*) to be mated with each other, as shown in FIG. 3B. Additionally, or alternatively, the male portions of the gear-like design may have a positive or negative magnetic field and the female portions of the gear-like design may have a magnetic field opposite that of the male portions. In these examples, the buttons 306(*a*)-(*d*) may be held together via magnetic attraction of the male and female portions of the buttons 306(*a*)-(*d*).

Figure 4B:
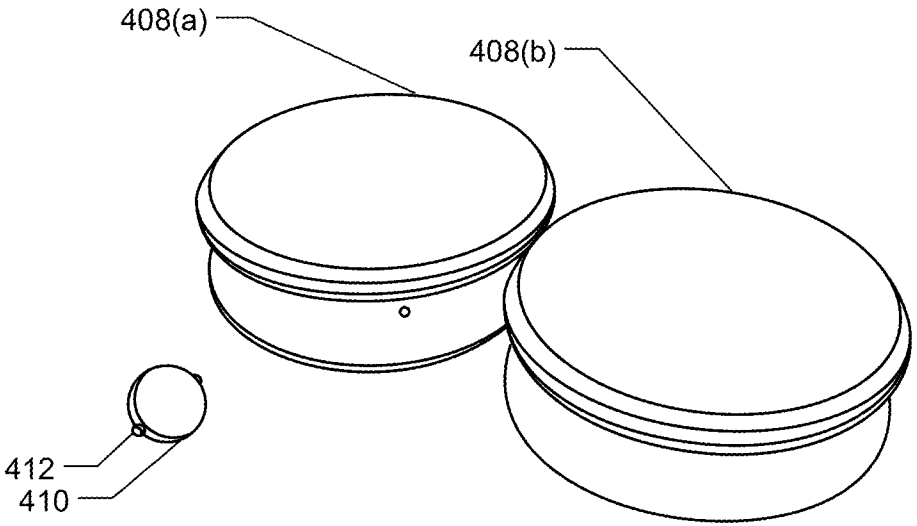
FIG. 4B illustrates two example devices similar to the button from FIG. 4A along with an example connector.
Figure 4A:
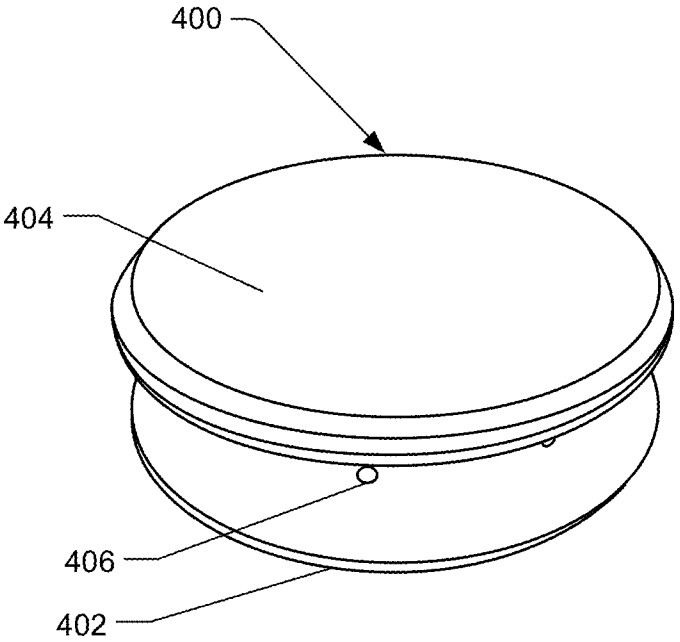
FIG. 4A illustrates another example arrangeable device to which one or more actions may be assigned.

FIG. 4A illustrates another example button 400 as described herein. The button 400 may have the same or similar components as the button 200 described with respect to FIG. 2A. For example, the button 400 may have a base portion 402 and an actuatable portion 404. Other components of button 400 may include one or more of the following: one or more processors; one or more network interfaces; memory; one or more microphones; one or more speakers; one or more light elements; one or more gyroscopes; one or more accelerometers; one or more global positioning system (GPS) components; and/or one or more radio-frequency identification components. In examples, the components of the button 400 may be configured to send and receive data associated with actuation of the button 400. As shown in FIG. 4A, the shape of the base portion 402 of the button 400 may differ from the base portion 202 of the button 200 from FIG. 2A. Here, the base portion 402 may have one or more slots 406 that may be configured to receive other buttons, and/or a connector. The slots 406 may include one or more sensors that may identify when a connector and/or another button comes into contact with the slots 406. The sensors may generate data indicating which slots 406 of the button 400 are in contact with the connector and/or other button, which may indicate a position and/or orientation of the button 400 with respect to other buttons, the connector, and/or the environment in which the button 400 is situated.

FIG. 4B illustrates two example buttons 408(*a*)-(*b*) similar to the button 400 from FIG. 4A along with an example connector 410. The connector 410 may have one or more prongs 412 sized to fit into the slots 406 of the buttons 408(*a*)-(*b*). The prongs 412 may have one or more sensors that may generate data indicating which prongs 412 of the connector 410 are in contact with the buttons 408(*a*)-(*b*), which may indicate a position and/or orientation of the buttons 408(*a*)-(*b*) with respect to each other and/or the connector 410. While one connector 410 is depicted in FIG. 4B, it should be understood that one or more than one connectors 410 may be utilized. For example, given a connector 410 of a size and shape of the one depicted in FIG. 4B, there may be a connector to couple each button being utilized. For example, in a three-button setup, two connectors 410 may be present.

Figure 5:
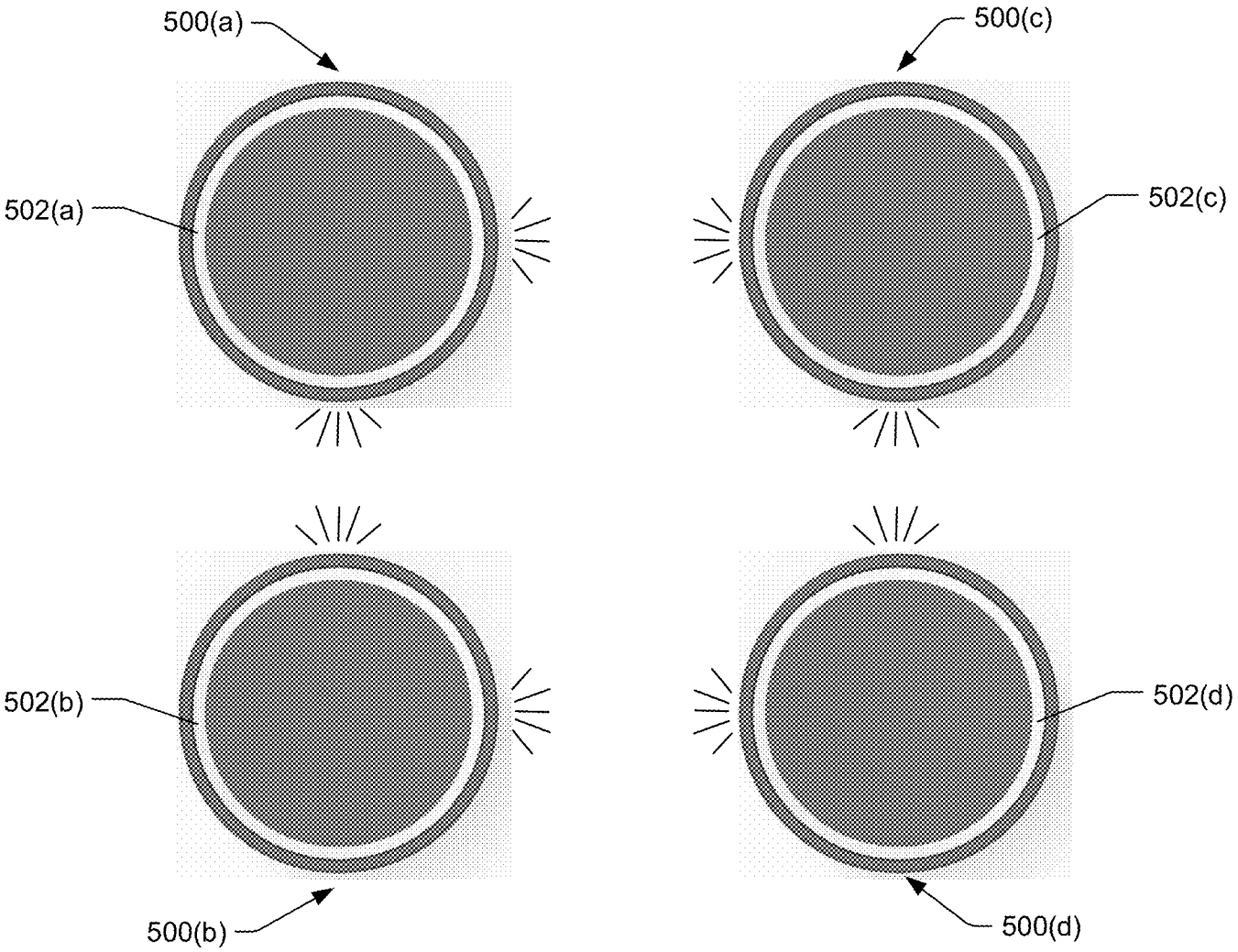
FIG. 5 illustrates four example devices with lighting elements as indicators.

FIG. 5 illustrates four example buttons 500(*a*)-(*d*) with light emitting diodes (LEDs) as indicators. The buttons 500(*a*)-(*d*) may have the same or similar components as the button 200 described with respect to FIG. 2A. For example, the buttons 500(*a*)-(*d*) may have a base portion and an actuatable portion. Other components of buttons 500(*a*)-(*d*) may include one or more of the following: one or more processors; one or more network interfaces; memory; one or more microphones; one or more speakers; one or more light elements 502(*a*)-(*d*); one or more gyroscopes; one or more accelerometers; one or more global positioning system (GPS) components; and/or one or more radio-frequency identification components. In examples, the components of the buttons 500(*a*)-(*d*) may be configured to send and receive data associated with actuation of the buttons 500 (*a*)-(*d*).

The light elements 502(*a*)-(*d*) may include one or more LEDs, which may be disposed around a perimeter of some or all of the buttons 500(*a*)-(*d*). The LEDs may emit light, in examples, based at least in part on instruction data representing instructions to arrange the buttons 500(*a*)-(*d*). For example, a first LED of a first button 500(*a*) may be caused to emit first light, a second LED of a second button 500(*b*) may be caused to emit second light, a third LED of the third button 500(*c*) may be caused to emit third light, and a fourth LED of a fourth button 500(*d*) may be caused to emit fourth light. An instruction may be presented to a user of the buttons 500(*a*)-(*d*) to orient the buttons 500(*a*)-(*d*) such that the illuminated LEDs are proximate to each other. As shown in FIG. 5, given the presence of four buttons 500(*a*)-(*d*), two LEDs of each light element 502(*a*)-(*d*) have been illuminated in a manner where only one arrangement of the buttons 500(*a*)-(*d*) with LEDs proximate to each other is possible.

Additionally, or alternatively, the color of the light emitted by the LEDs may provide a visual indication of how the buttons 500(*a*)-(*d*) are to be arranged. For example, the LED on the right side of the button 500(*a*) may emit a blue light while the LED on the left side of the button 500(*c*) may emit a similar blue light. This may provide a visual indication that the two buttons 500(*a*) and 500(*c*) should be placed such that similarly-colored LEDs are proximate to each other. In should be noted that while four buttons 500(*a*)-(*d*) are illustrated in FIG. 5, less or more than four buttons 500(*a*)-(*d*) are possible. The number of LEDs, or illuminated LEDs, per light element 502(*a*)-(*d*) may also depend on the number of buttons 500(*a*)-(*d*) utilized.

Figure 6:
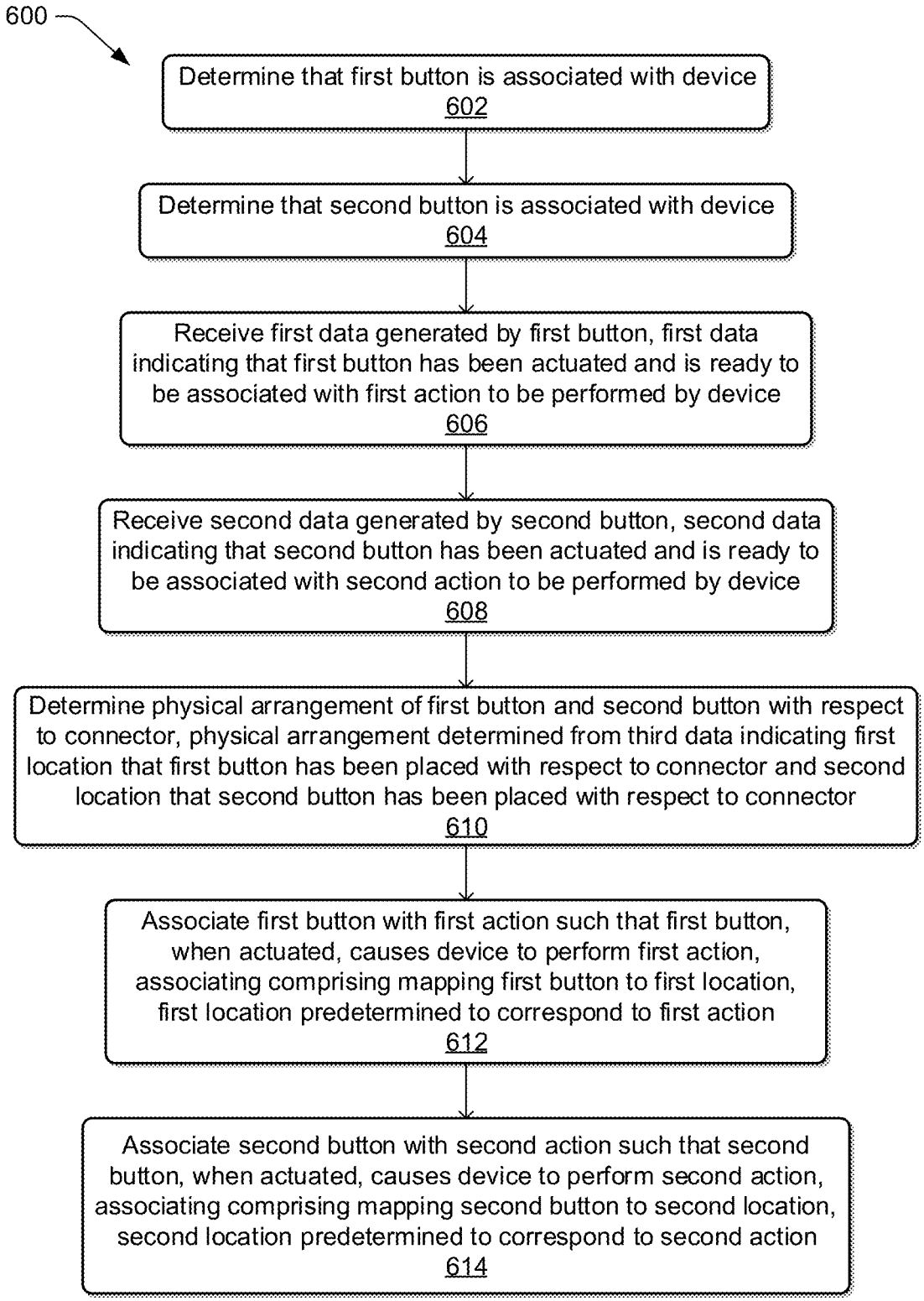
FIG. 6 illustrates a flow diagram of an example process for device arrangement and action assignment.
Figure 7:
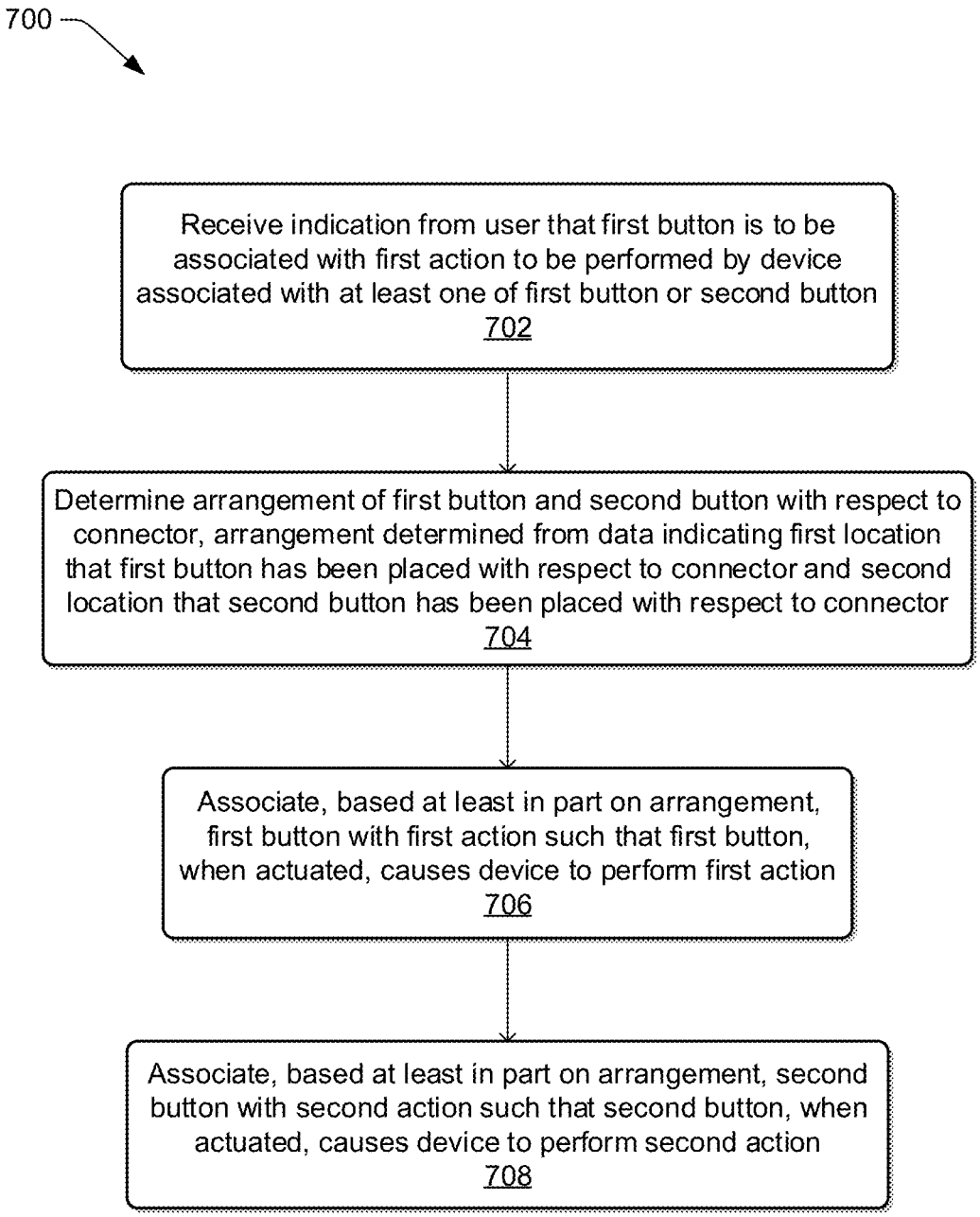
FIG. 7 illustrates a flow diagram of another example process for device arrangement and action assignment.
Figure 8:
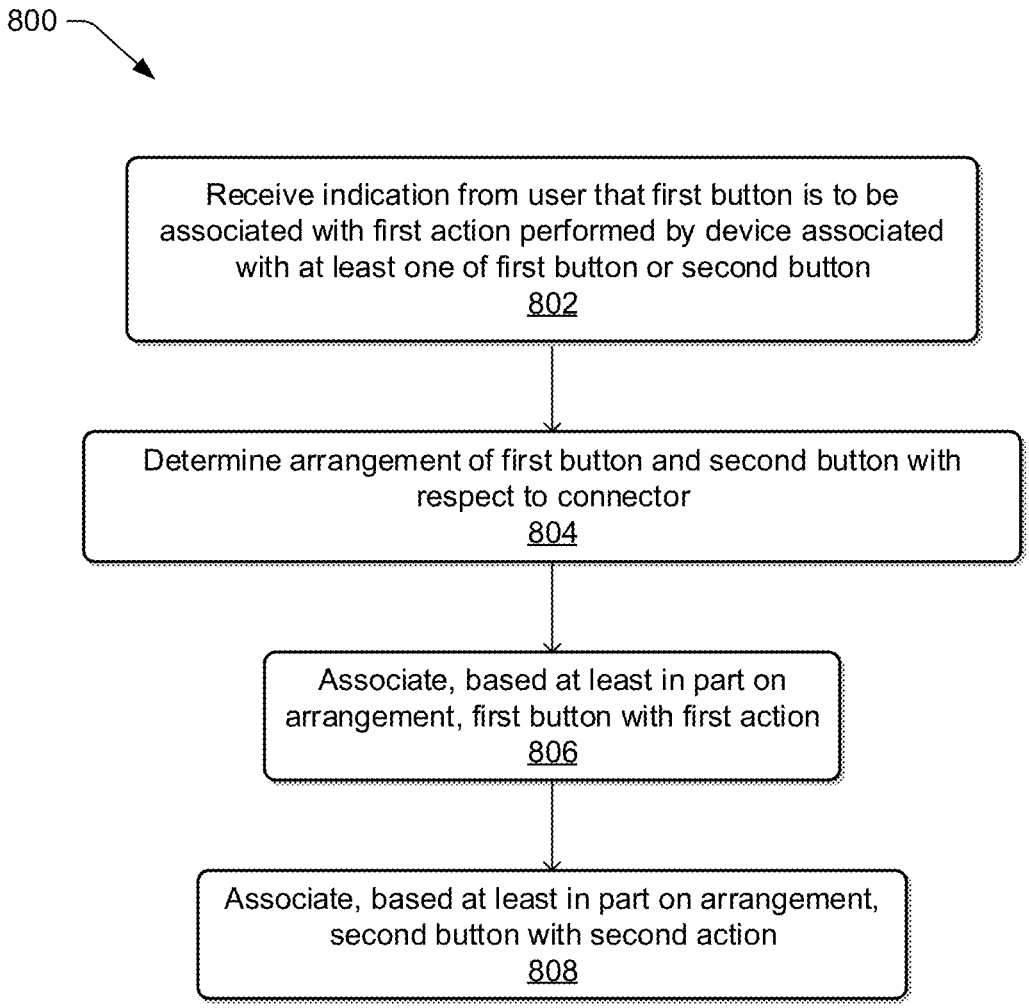
FIG. 8 illustrates a flow diagram of another example process for device arrangement and action assignment.

FIGS. 6-8 illustrate various processes for button arrangement and action assignment. The processes described herein are illustrated as collections of blocks in logical flow diagrams, which represent a sequence of operations, some or all of which may be implemented in hardware, software or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed. For discussion purposes, the processes are described with reference to the environments, architectures and systems described in the examples herein, such as, for example those described with respect to FIGS. 1-5, 13, and 14, although the processes may be implemented in a wide variety of other environments, architectures and systems.

FIG. 6 illustrates a flow diagram of an example process 600 for button arrangement and action assignment. The order in which the operations or steps are described is not intended to be construed as a limitation, and any number of the described operations may be combined in any order and/or in parallel to implement process 600.

At block 602, process 600 may include determining that a first button is associated with a device. This determination may be based at least in part on information identified, determined, and/or generated by a profile/account component of a remote system, such as the user profile/account component 156 of the remote system 116 from FIG. 1, described above. The association between a device and one or more buttons may additionally, or alternatively, be based at least in part on communications sent between the buttons and the device. For example, pairing, such as Bluetooth pairing, of the buttons to the device may be performed, and an indication of this pairing may be utilized to determine that the first button and the second button are associated with the device. A connector, as described with respect to FIG. 1 above, may additionally, or alternatively, be used to determine the association between the buttons and the device. Additionally, or alternatively, the device may include means to determine that one or more buttons are within a threshold proximity of the device. This proximity determination may be based at least in part on data from RFID components of the buttons, connectors, and/or device, data from GPS components of the buttons, connectors, and/or device, time-of-flight information from audio generated and/or produced by the buttons captured by microphones of the device, visual information indicating distance to buttons captured by one or more cameras of the device, and/or other distance-determining means.

At block 604, the process 600 may include determining that a second button is associated with the device. This determination may be made based at least in part on the same or similar information and techniques described above with respect to block 602.

At block 606, the process 600 may include receiving first data generated by the first button. The first data may indicate that the first button has been actuated and is ready to be associated with a first action to be performed by the device. The first data may be based at least in part on a user command. For example, microphones of the device may capture audio from the user representing a command to utilize one or more of the buttons. The microphones may generate corresponding audio data and automatic speech recognition and natural language understanding techniques may be utilized to determine the intended command. Additionally, or alternatively, the user may provide a command to utilize one or more of the buttons via touch input on the device. Additionally, or alternatively, the user may access an application that utilizes the buttons and the first indication may be based at least in part on the application being accessed. Additionally, or alternatively, the user may activate one or more of the buttons and/or actuate one or more of the buttons. Data corresponding to this actuation may be sent from the buttons and/or from a connector associated with the buttons to the device and/or to the remote system.

At bock 608, the process 600 may include receiving second data generated by the second button. The second data may indicate that the second button has been actuated and is ready to be associated with a second action to be performed by the device. The second data may be based at least in part on some or all of the information identified, determined, and/or generated as described with respect to blocks 602 and/or 604. Additionally, or alternatively, the second data may be based at least in part on a previous association of the first button with the second button and/or a detected proximity of the first button to the second button and/or data indicating that the first button and the second button are coupled to the connector.

At block 610, the process 600 may include determining a physical arrangement of the first button and the second button with respect to a connector. The physical arrangement may be determined from third data indicating a first location that the first button is placed with respect to the connector and/or a second location that the second button has been placed with respect to the connector. The arrangement of the buttons may be determined with respect to other buttons, with respect to a connector, and/or with respect to an environment in which the buttons are situated. One or more methods of determining the arrangement of buttons may be utilized. For example, when the connector includes one or more sensors that determine which buttons are received by the connector and/or where those buttons are positioned with respect to the connector, determining the arrangement of the buttons may be based at least in part on data received from the connector indicating the identity and positional placement of the buttons. This data may be utilized to identify and/or determine the button arrangement. Additionally, or alternatively, data indicating button identity and positional placement with respect to the connector and/or between buttons may be determined based at least in part on sensors of the buttons themselves. In these examples, the arrangement data may be sent from the buttons to the remote system to identify and/or determine the button arrangement. This communication may be via the user devices and the network.

Additionally, or alternatively, data indicating that the buttons have been actuated pursuant to instructions provided to a user may be utilized to determine button arrangement. For example, instruction data may be sent to the user device. The instruction data may represent one or more instructions to arrange the buttons. Presentation of the instructions, such as audible presentation in the case of a voice-assistant device and/or visual presentation in the case of a mobile device, may be performed. The instructions may direct a user to arrange the buttons in a particular order or location with respect to each other, with respect to the connector, and/or with respect to an environment in which the buttons are situated. The instructions may direct the user to actuate the buttons once the user has completed arrangement of the buttons pursuant to the instructions. Signals representing actuation of the buttons may be sent from the buttons and/or the connector to the user device and/or the remote system to confirm button arrangement. By way of example, instruction data may be sent to the device. The instruction data may represent a first instruction to arrange the first button and a second instruction to arrange the second button. First audio may be output corresponding to the first instruction and may direct a user to couple the first button to a first portion of the connector. A first signal may be received from the first button indicating that the first button has been actuated. Based at least in part on receiving the first signal, second audio corresponding to the second instruction may be output. The second audio may direct the user to couple the second button to a second portion of the connector. A second signal may be received from the second button indicating that the second button has been actuated. In this example, determining the physical arrangement of the buttons may be based at least in part on receiving the first signal and the second signal.

Additionally, or alternatively, button arrangement may be based at least in part on an application being utilized and/or accessed by the user device. For example, a user may be utilizing a light-control application, or a video game application, or a teaching application. Each of these applications may be associated with different button functionalities and/or different button arrangements. This information may be utilized, at least in part, to determine the arrangement of the buttons.

Additionally, or alternatively, the button arrangement may be based at least in part on a magnetic field generated by the buttons. The use of magnetic fields to identify, determine, and/or cause button arrangements is described in more detail with respect to FIGS. 3A and 3B. Generally, the buttons may include portions with positive magnetic fields and other portions with negative magnetic fields. The differing magnetic fields may be utilized to couple the buttons together and/or couple the buttons to the connector. The buttons and/or the connector may generate data indicating that the buttons have been coupled together and/or that the buttons have been coupled to the connector at various positions with respect to the buttons and/or the connector. In other examples, the magnetic fields associated with a button may be dynamic. For example, one or more magnetic fields may be induced with respect to a first button and a second button. The induced magnetic fields may cause the buttons, when brought into proximity to each other, to couple together in a specific arrangement.

Additionally, or alternatively, the button arrangement may be based at least in part on LEDs associated with the buttons. For example, the buttons may include one or more LEDs, which may be disposed around a perimeter of some or all of the buttons. The LEDs may emit light, in examples, based at least in part on instruction data representing instructions to arrange the buttons. For example, a first LED of a first button may be caused to emit first light while a second LED of a second button may be caused to emit second light. An instruction may be presented to a user of the buttons to orient the first button and the second button such that the first LED and the second LED are proximate to each other. Additional details regarding LED arrangement of the buttons are described with respect to FIG. 5.

Additionally, or alternatively, the button arrangement may be based at least in part on the position of the connector as detected by the buttons. For example, some or all of the buttons may include one or more slots and/or prongs. The slots and/or prongs may include one or more sensors that may identify when a connector and/or another button comes into contact with the slots and/or prongs. The sensors may generate data indicating which slots and/or prongs of the buttons are in contact with the connector and/or other button, which may indicate a position and/or orientation of a button with respect to other buttons, the connector, and/or the environment in which the button is situated. Additional details on utilizing button slots and/or prongs for button arrangement is described with respect to FIGS. 4A and 4B.

Additionally, or alternatively, the button arrangement may be based at least in part on user-configurable settings associated with the buttons. For example, a user may provide input, such as audible input and/or touch input, such as when the user device is a mobile phone, to the user device that indicates an arrangement of the buttons. This input may be utilized to identify the button arrangement.

Additionally, or alternatively, the button arrangement may be based at least in part on a proximity of one or more buttons to various user devices. For example, an environment may have multiple user devices disposed therein, such as multiple voice-assistant devices. The button arrangement may be based at least in part on data indicating that one or more of the buttons is in closer proximity to a first user device than a second user device. This data may indicate that a first arrangement of the buttons associated with the first user device may be identified and/or determined. By way of example, a first user device may be situated in a game room of a home while a second user device may be situated in a kitchen of a home. Each of these user devices may be associated with actions and/or tasks that are typically performed in the environments in which the user devices are situated. This information may be utilized to determine that buttons that are in close proximity to these user devices may be utilized to perform the environment-specific actions and/or tasks. Identifying and/or determining the button arrangement may be based at least in part on this information.

Additionally, or alternatively, determination of when the arrangement of the buttons has changed and/or remained static may be performed. For example, a threshold period of time may be utilized to determine if the arrangement of the buttons has changed. In this example, when an amount of time since one or more of the buttons were utilized is not more than the threshold period of time, it may be determined that the arrangement of the buttons has not changed. In this case, rearrangement of the buttons may not be performed. In examples, data representing a confirmation request may be sent to the user device and/or the accessory device. The confirmation request may query the user to provide an indication that the button arrangement has not changed. In cases where the amount of time since the buttons were utilized is more than the threshold period of time, it may be determined that the arrangement of the buttons has likely changed. Additionally, or alternatively, the determination of whether the buttons should be rearranged may be based at least in part on gyroscopic data from a gyroscope associated with a button, accelerometer data from an accelerometer associated with a button, GPS data from GPS components associated with a button, and/or RFID data from RFID components associated with a button. This data may provide an indication that the orientation, position, and/or placement of the buttons have changed since the last time one or more of the buttons was utilized.

At block 612, the process 600 may include associating the first button with the first action such that the first button, when actuated, causes the device to perform the first action. Associating the first button with the first action may include mapping the first button to the first location. The first location may correspond to a predetermined action associated with that location of the button. Associating the first button with the first action may include assigning the first action to the first button. Assignment of the actions to the buttons may additionally, or alternatively, be based at least in part on user indications of which actions are to be performed when some or all of the buttons are actuated. Assigning an action to a button may include identifying the button to which the action is to be assigned, identifying and/or determining an action to be performed by the button and/or another device in response to actuation of the button, and associating the identified button with the action such that, when a signal is received that the button has been actuated, the memory of the buttons, connectors, and/or other devices causes the processors of the buttons, connectors, and/or other devices to perform the action and/or cause the action to be performed.

At block 614, the process 600 may include associating the second button with the second action such that the second button, when actuated, causes the device to perform the second action. Associating the second button with the second action may include mapping the second button to the second location. The second location may correspond to a predetermined action. Associating the second button with the second action may be performed in the same or a similar manner as described at block 612 above with respect to associating the first button with the first action.

FIG. 7 illustrates a flow diagram of another example process 700 for button arrangement and action assignment. The order in which the operations or steps are described is not intended to be construed as a limitation, and any number of the described operations may be combined in any order and/or in parallel to implement process 700.

At block 702, process 700 may include receiving an indication from a user that a first button is to be associated with a first action to be performed by a device associated with at least one of the first button or a second button. The indication may be based at least in part on a user command. For example, microphones of the device may capture audio from the user representing a command to utilize one or more of the buttons. The microphones may generate corresponding audio data and automatic speech recognition and natural language understanding techniques may be utilized to determine the intended command. Additionally, or alternatively, the user may provide a command to utilize one or more of the buttons via touch input on the device. Additionally, or alternatively, the user may access an application that utilizes the buttons and the indication may be based at least in part on the application being accessed. Additionally, or alternatively, the user may activate one or more of the buttons and/or actuate one or more of the buttons. A signal corresponding to this actuation may be sent from the buttons and/or from a connector associated with the buttons to the device and/or to the remote system. The indication may be based at least in part on receipt of this signal.

At block 704, the process 700 may include determining an arrangement of the first button and the second button with respect to a connector. The arrangement may be determined from data indicating a first location that the first button has been placed with respect to the connector and a second location that the second button has been placed with respect to the connector. One or more methods of determining the arrangement of buttons may be utilized. For example, when the connector includes one or more sensors that determine which buttons are received by the connector and/or where those buttons are positioned with respect to the connector, determining the arrangement of the buttons may be based at least in part on data received from the connector indicating the identity and positional placement of the buttons. This data may be utilized to identify and/or determine the button arrangement. Additionally, or alternatively, data indicating button identity and positional placement with respect to the connector and/or between buttons may be determined based at least in part on sensors of the buttons themselves. In these examples, the arrangement data may be sent from the buttons to the remote system to identify and/or determine the button arrangement. This communication may be via the user devices and the network.

Additionally, or alternatively, data indicating that the buttons have been actuated pursuant to instructions provided to a user may be utilized to determine button arrangement. For example, instruction data may be sent to the user device. The instruction data may represent one or more instructions to arrange the buttons. Presentation of the instructions, such as audible presentation in the case of a voice-assistant device and/or visual presentation in the case of a mobile device, may be performed. The instructions may direct a user to arrange the buttons in a particular order or location with respect to each other, with respect to the connector, and/or with respect to an environment in which the buttons are situated. The instructions may direct the user to actuate the buttons once the user has completed arrangement of the buttons pursuant to the instructions. Signals representing actuation of the buttons may be sent from the buttons and/or the connector to the user device and/or the remote system to confirm button arrangement. By way of example, instruction data may be sent to the device. The instruction data may represent a first instruction to arrange the first button and a second instruction to arrange the second button. First audio may be output corresponding to the first instruction and may direct a user to couple the first button to a first portion of the connector. A first signal may be received from the first button indicating that the first button has been actuated. Based at least in part on receiving the first signal, second audio corresponding to the second instruction may be output. The second audio may direct the user to couple the second button to a second portion of the connector. A second signal may be received from the second button indicating that the second button has been actuated. In this example, determining the physical arrangement of the buttons may be based at least in part on receiving the first signal and the second signal.

Additionally, or alternatively, button arrangement may be based at least in part on an application being utilized and/or accessed by the user device. For example, a user may be utilizing a light-control application, or a video game application, or a teaching application. Each of these applications may be associated with different button functionalities and/or different button arrangements. This information may be utilized, at least in part, to determine the arrangement of the buttons.

Additionally, or alternatively, the button arrangement may be based at least in part on a magnetic field generated by the buttons. The use of magnetic fields to identify, determine, and/or cause button arrangements is described in more detail with respect to FIGS. 3A and 3B. Generally, the buttons may include portions with positive magnetic fields and other portions with negative magnetic fields. The differing magnetic fields may be utilized to couple the buttons together and/or couple the buttons to the connector. The buttons and/or the connector may generate data indicating that the buttons have been coupled together and/or that the buttons have been coupled to the connector at various positions with respect to the buttons and/or the connector. In other examples, the magnetic fields associated with a button may be dynamic. For example, one or more magnetic fields may be induced with respect to a first button and a second button. The induced magnetic fields may cause the buttons, when brought into proximity to each other, to couple together in a specific arrangement.

Additionally, or alternatively, the button arrangement may be based at least in part on LEDs associated with the buttons. For example, the buttons may include one or more LEDs, which may be disposed around a perimeter of some or all of the buttons. The LEDs may emit light, in examples, based at least in part on instruction data representing instructions to arrange the buttons. For example, a first LED of a first button may be caused to emit first light while a second LED of a second button may be caused to emit second light. An instruction may be presented to a user of the buttons to orient the first button and the second button such that the first LED and the second LED are proximate to each other. Additional details regarding LED arrangement of the buttons are described with respect to FIG. 5.

Additionally, or alternatively, the button arrangement may be based at least in part on the position of the connector as detected by the buttons. For example, some or all of the buttons may include one or more slots and/or prongs. The slots and/or prongs may include one or more sensors that may identify when a connector and/or another button comes into contact with the slots and/or prongs. The sensors may generate data indicating which slots and/or prongs of the buttons are in contact with the connector and/or other button, which may indicate a position and/or orientation of a button with respect to other buttons, the connector, and/or the environment in which the button is situated. Additional details on utilizing button slots and/or prongs for button arrangement is described with respect to FIGS. 4A and 4B.

Additionally, or alternatively, the button arrangement may be based at least in part on user-configurable settings associated with the buttons. For example, a user may provide input, such as audible input and/or touch input, such as when the user device is a mobile phone, to the user device that indicates an arrangement of the buttons. This input may be utilized to identify the button arrangement.

Additionally, or alternatively, the button arrangement may be based at least in part on a proximity of one or more buttons to various user devices. For example, an environment may have multiple user devices disposed therein, such as multiple voice-assistant devices. The button arrangement may be based at least in part on data indicating that one or more of the buttons is in closer proximity to a first user device than a second user device. This data may indicate that a first arrangement of the buttons associated with the first user device may be identified and/or determined. By way of example, a first user device may be situated in a game room of a home while a second user device may be situated in a kitchen of a home. Each of these user devices may be associated with actions and/or tasks that are typically performed in the environments in which the user devices are situated. This information may be utilized to determine that buttons that are in close proximity to these user devices may be utilized to perform the environment-specific actions and/or tasks. Identifying and/or determining the button arrangement may be based at least in part on this information.

Additionally, or alternatively, determination of when the arrangement of the buttons has changed and/or remained static may be performed. For example, a threshold period of time may be utilized to determine if the arrangement of the buttons has changed. In this example, when an amount of time since one or more of the buttons were utilized is not more than the threshold period of time, it may be determined that the arrangement of the buttons has not changed. In this case, rearrangement of the buttons may not be performed. In examples, data representing a confirmation request may be sent to the user device and/or the accessory device. The confirmation request may query the user to provide an indication that the button arrangement has not changed. In cases where the amount of time since the buttons were utilized is more than the threshold period of time, it may be determined that the arrangement of the buttons has likely changed. Additionally, or alternatively, the determination of whether the buttons should be rearranged may be based at least in part on gyroscopic data from a gyroscope associated with a button, accelerometer data from an accelerometer associated with a button, GPS data from GPS components associated with a button, and/or RFID data from RFID components associated with a button. This data may provide an indication that the orientation, position, and/or placement of the buttons have changed since the last time one or more of the buttons was utilized.

To illustrate the rearrangement of buttons determination described above, a first arrangement of the buttons may be determined. Thereafter, an indication may be received that at least one of the first button or the second button has been enabled. If the indication is received after a threshold amount of time from when the first arrangement was determined, a second arrangement of the first button and the second button may be identified, determined, and/or caused. The threshold amount of time may be static, such as two minutes, three minutes, five minutes, 15 minutes, 30 minutes, one hour, one day, etc. The threshold amount of time may alternatively be dynamic and may depend on the first arrangement of the buttons, the application accessed by the device, and/or usage of the device since the first arrangement of the buttons, for example. Additionally, or alternatively, motion data from a motion sensor associated with the first button and/or the second button may be received and a determination may be made that the first arrangement has changed. The second arrangement may be identified, determined, and/or caused based at least in part on receiving the motion data. Once the second arrangement is identified, determined, and/or caused, the first button may be associated with a third action and the second button may be associated with a fourth action.

At block 706, the process 700 may include associating the first button with the first action such that the first button, when actuated, causes the device to perform the first action. Associating the first button with the first action may be based at least in part on the arrangement. Associating the first button with the first action may include assigning the first action to the first button. Assignment of the actions to the buttons may additionally, or alternatively, be based at least in part on user indications of which actions are to be performed when some or all of the buttons are actuated. Assigning an action to a button may include identifying the button to which the action is to be assigned, identifying and/or determining an action to be performed by the button and/or another device in response to actuation of the button, and associating the identified button with the action such that, when a signal is received that the button has been actuated, the memory of the buttons, connectors, and/or other devices causes the processors of the buttons, connectors, and/or other devices to perform the action and/or cause the action to be performed.

At block 708, the process 700 may include associating the second button with the second action such that the second button, when actuated, causes the device to perform the second action. Associating the second button with the second action may be based at least in part on the arrangement. Associating the second button with the second action may be performed in the same or a similar manner as described at block 706 above with respect to associating the first button with the first action.

FIG. 8 illustrates a flow diagram of an example process 800 for button arrangement and action assignment. The order in which the operations or steps are described is not intended to be construed as a limitation, and any number of the described operations may be combined in any order and/or in parallel to implement process 800.

At block 802, process 800 may include receiving an indication from a user that a first button is to be associated with a first action performed by a device associated with at least one of the first button or the second button. The indication may be based at least in part on a user command. For example, microphones of the device may capture audio from the user representing a command to utilize one or more of the buttons. The microphones may generate corresponding audio data and automatic speech recognition and natural language understanding techniques may be utilized to determine the intended command. Additionally, or alternatively, the user may provide a command to utilize one or more of the buttons via touch input on the device. Additionally, or alternatively, the user may access an application that utilizes the buttons and the indication may be based at least in part on the application being accessed. Additionally, or alternatively, the user may activate one or more of the buttons and/or actuate one or more of the buttons. A signal corresponding to this actuation may be sent from the buttons and/or from a connector associated with the buttons to the device and/or to the remote system. The indication may be based at least in part on receipt of this signal.

At block 804, the process 800 may include determining an arrangement of the first button and the second button with respect to a connector associated with the first button and the second button. One or more methods of determining the arrangement of buttons may be utilized. For example, when the connector includes one or more sensors that determine which buttons are received by the connector and/or where those buttons are positioned with respect to the connector, determining the arrangement of the buttons may be based at least in part on data received from the connector indicating the identity and positional placement of the buttons. This data may be utilized to identify and/or determine the button arrangement. Additionally, or alternatively, data indicating button identity and positional placement with respect to the connector and/or between buttons may be determined based at least in part on sensors of the buttons themselves. In these examples, the arrangement data may be sent from the buttons to the remote system to identify and/or determine the button arrangement. This communication may be via the user devices and the network.

Additionally, or alternatively, data indicating that the buttons have been actuated pursuant to instructions provided to a user may be utilized to determine button arrangement. For example, instruction data may be sent to the user device. The instruction data may represent one or more instructions to arrange the buttons. Presentation of the instructions, such as audible presentation in the case of a voice-assistant device and/or visual presentation in the case of a mobile device, may be performed. The instructions may direct a user to arrange the buttons in a particular order or location with respect to each other, with respect to the connector, and/or with respect to an environment in which the buttons are situated. The instructions may direct the user to actuate the buttons once the user has completed arrangement of the buttons pursuant to the instructions. Signals representing actuation of the buttons may be sent from the buttons and/or the connector to the user device and/or the remote system to confirm button arrangement. By way of example, instruction data may be sent to the device. The instruction data may represent a first instruction to arrange the first button and a second instruction to arrange the second button. First audio may be output corresponding to the first instruction and may direct a user to couple the first button to a first portion of the connector. A first signal may be received from the first button indicating that the first button has been actuated. Based at least in part on receiving the first signal, second audio corresponding to the second instruction may be output. The second audio may direct the user to couple the second button to a second portion of the connector. A second signal may be received from the second button indicating that the second button has been actuated. In this example, determining the physical arrangement of the buttons may be based at least in part on receiving the first signal and the second signal.

Additionally, or alternatively, button arrangement may be based at least in part on an application being utilized and/or accessed by the user device. For example, a user may be utilizing a light-control application, or a video game application, or a teaching application. Each of these applications may be associated with different button functionalities and/or different button arrangements. This information may be utilized, at least in part, to determine the arrangement of the buttons.

Additionally, or alternatively, the button arrangement may be based at least in part on a magnetic field generated by the buttons. The use of magnetic fields to identify, determine, and/or cause button arrangements is described in more detail with respect to FIGS. 3A and 3B. Generally, the buttons may include portions with positive magnetic fields and other portions with negative magnetic fields. The differing magnetic fields may be utilized to couple the buttons together and/or couple the buttons to the connector. The buttons and/or the connector may generate data indicating that the buttons have been coupled together and/or that the buttons have been coupled to the connector at various positions with respect to the buttons and/or the connector. In other examples, the magnetic fields associated with a button may be dynamic. For example, one or more magnetic fields may be induced with respect to a first button and a second button. The induced magnetic fields may cause the buttons, when brought into proximity to each other, to couple together in a specific arrangement.

Additionally, or alternatively, the button arrangement may be based at least in part on LEDs associated with the buttons. For example, the buttons may include one or more LEDs, which may be disposed around a perimeter of some or all of the buttons. The LEDs may emit light, in examples, based at least in part on instruction data representing instructions to arrange the buttons. For example, a first LED of a first button may be caused to emit first light while a second LED of a second button may be caused to emit second light. An instruction may be presented to a user of the buttons to orient the first button and the second button such that the first LED and the second LED are proximate to each other. Additional details regarding LED arrangement of the buttons are described with respect to FIG. 5.

Additionally, or alternatively, the button arrangement may be based at least in part on the position of the connector as detected by the buttons. For example, some or all of the buttons may include one or more slots and/or prongs. The slots and/or prongs may include one or more sensors that may identify when a connector and/or another button comes into contact with the slots and/or prongs. The sensors may generate data indicating which slots and/or prongs of the buttons are in contact with the connector and/or other button, which may indicate a position and/or orientation of a button with respect to other buttons, the connector, and/or the environment in which the button is situated. Additional details on utilizing button slots and/or prongs for button arrangement is described with respect to FIGS. 4A and 4B.

Additionally, or alternatively, the button arrangement may be based at least in part on user-configurable settings associated with the buttons. For example, a user may provide input, such as audible input and/or touch input, such as when the user device is a mobile phone, to the user device that indicates an arrangement of the buttons. This input may be utilized to identify the button arrangement.

Additionally, or alternatively, the button arrangement may be based at least in part on a proximity of one or more buttons to various user devices. For example, an environment may have multiple user devices disposed therein, such as multiple voice-assistant devices. The button arrangement may be based at least in part on data indicating that one or more of the buttons is in closer proximity to a first user device than a second user device. This data may indicate that a first arrangement of the buttons associated with the first user device may be identified and/or determined. By way of example, a first user device may be situated in a game room of a home while a second user device may be situated in a kitchen of a home. Each of these user devices may be associated with actions and/or tasks that are typically performed in the environments in which the user devices are situated. This information may be utilized to determine that buttons that are in close proximity to these user devices may be utilized to perform the environment-specific actions and/or tasks. Identifying and/or determining the button arrangement may be based at least in part on this information.

Additionally, or alternatively, determination of when the arrangement of the buttons has changed and/or remained static may be performed. For example, a threshold period of time may be utilized to determine if the arrangement of the buttons has changed. In this example, when an amount of time since one or more of the buttons were utilized is not more than the threshold period of time, it may be determined that the arrangement of the buttons has not changed. In this case, rearrangement of the buttons may not be performed. In examples, data representing a confirmation request may be sent to the user device and/or the accessory device. The confirmation request may query the user to provide an indication that the button arrangement has not changed. In cases where the amount of time since the buttons were utilized is more than the threshold period of time, it may be determined that the arrangement of the buttons has likely changed. Additionally, or alternatively, the determination of whether the buttons should be rearranged may be based at least in part on gyroscopic data from a gyroscope associated with a button, accelerometer data from an accelerometer associated with a button, GPS data from GPS components associated with a button, and/or RFID data from RFID components associated with a button. This data may provide an indication that the orientation, position, and/or placement of the buttons have changed since the last time one or more of the buttons was utilized.

To illustrate the rearrangement of buttons determination described above, a first arrangement of the buttons may be determined. Thereafter, an indication may be received that at least one of the first button or the second button has been enabled. If the indication is received after a threshold amount of time from when the first arrangement was determined, a second arrangement of the first button and the second button may be identified, determined, and/or caused. The threshold amount of time may be static, such as two minutes, three minutes, five minutes, 15 minutes, 30 minutes, one hour, one day, etc. The threshold amount of time may alternatively be dynamic and may depend on the first arrangement of the buttons, the application accessed by the device, and/or usage of the device since the first arrangement of the buttons, for example. Additionally, or alternatively, motion data from a motion sensor associated with the first button and/or the second button may be received and a determination may be made that the first arrangement has changed. The second arrangement may be identified, determined, and/or caused based at least in part on receiving the motion data. Once the second arrangement is identified, determined, and/or caused, the first button may be associated with a third action and the second button may be associated with a fourth action.

At block 806, the process 800 may include associating the first button with the first action based at least in part on the arrangement. Associating the first button with the first action may include assigning the first action to the first button. Assignment of the actions to the buttons may additionally, or alternatively, be based at least in part on user indications of which actions are to be performed when some or all of the buttons are actuated. Assigning an action to a button may include identifying the button to which the action is to be assigned, identifying and/or determining an action to be performed by the button and/or another device in response to actuation of the button, and associating the identified button with the action such that, when a signal is received that the button has been actuated, the memory of the buttons, connectors, and/or other devices causes the processors of the buttons, connectors, and/or other devices to perform the action and/or cause the action to be performed.

At block 808, the process 800 may include associating the second button with the second action based at least in part on the arrangement. Associating the second button with the second action may be performed in the same or a similar manner as described at block 806 above with respect to associating the first button with the first action.

Figure 9:
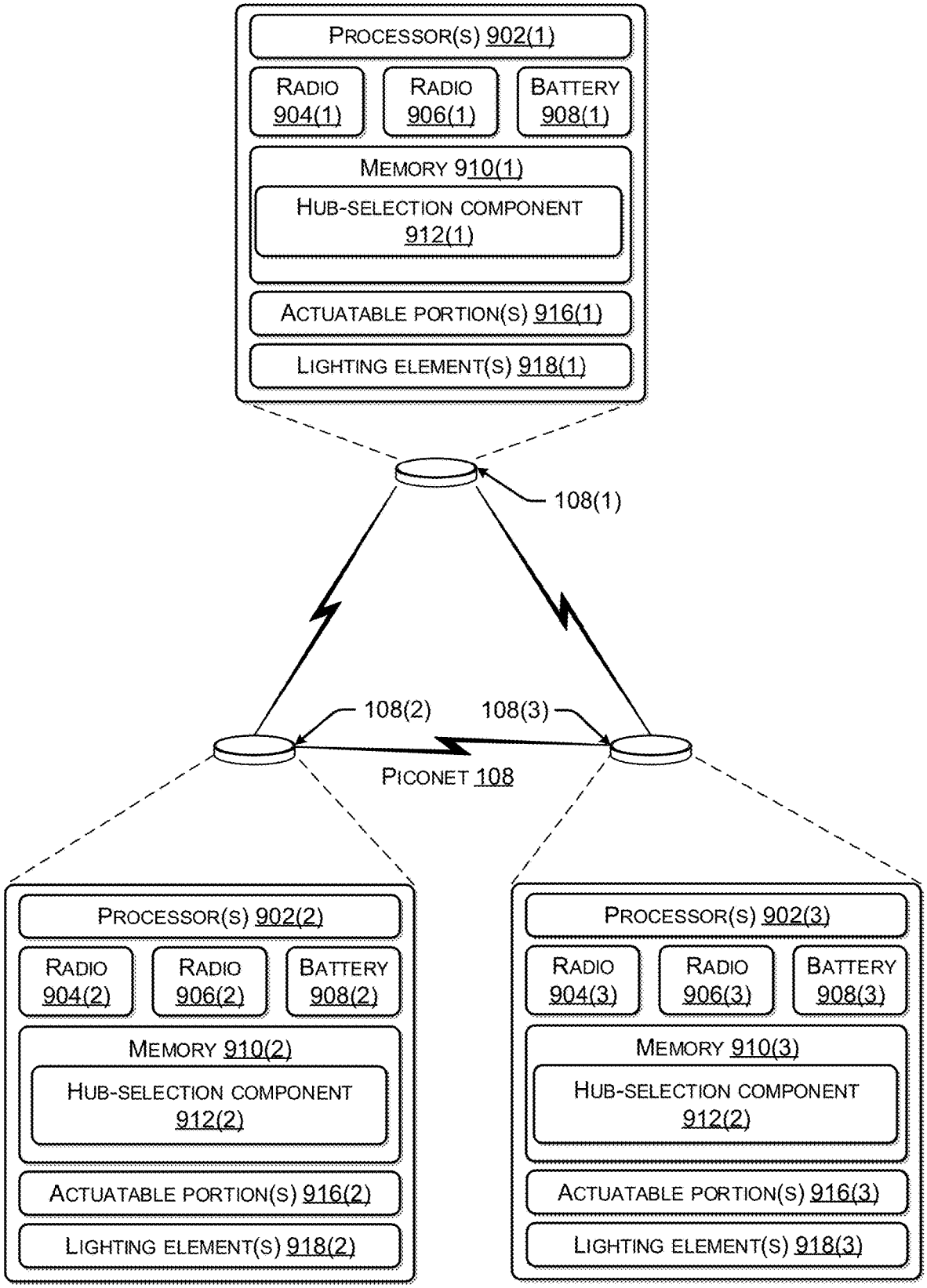
FIG. 9 illustrates example components of example arrangeable devices to which one or more actions may be assigned.

FIG. 9 illustrates example components of example buttons as described herein. As illustrated, button, also described as an accessory device, includes one or more processors 902(1), 902(2), and 902(3), a respective first radio component 904(1), 904(2), and 904(3) for communicating over a wireless network (e.g., LAN, WAN, etc.), and a respective second radio component 906(1), 906(2), and 906(3) for communicating over a short-range wireless connection. As noted above, however, in some instances each accessory device 108(1)-(3) may include a single radio unit to communicate over multiple protocols (e.g., Bluetooth and BLE), two or more radio units to communicate over two or more protocols, or the like. As used herein, a "radio" and "radio component" may be used interchangeably. Again, in some instances, the devices include any other number of radios, including instances where the devices comprise a single radio configured to communicate over two or more different protocols.

In addition, each device may include a respective battery 908(1), 908(2), and 908(3). At any given time, each battery may have a particular battery life or level, representing a current charge of the battery. The battery life or level may be measured in any suitable manner, such as by a percentage of charge remaining, an amount of time remaining, or the like. While the techniques described herein are described with reference to devices powered by batteries, it is to be appreciated that the techniques may also apply to devices that receive constant power.

As illustrated, each accessory device may further include one or more actuatable portions 916(1), 916(2), and 916(3) as well as one or more lighting elements 918(1), 918(2), and 918(3). The actuatable portions may comprise physical buttons, soft buttons, or any other type of component that a user may select via a physical push or contact. The lighting elements, meanwhile, may comprise LED lights, LCD lights, or any other kind of lighting element configured to illuminate in one or more different colors.

In addition to the above, the devices 108(1)-(3) may include respective memory (or "computer-readable media") 910(1), 910(2), and 910(3), which may store respective instances of a hub-selection component 912(1), 912(2), and 912(3). The hub-selection components 912(1)-(3) may generate messages (e.g., battery-life messages, communication-strength messages, etc.) and one or more maps (e.g., battery-life maps, communication-strength maps, etc.), and may be used to select/determine the communication hub. Further, the hub-selection components 912(1)-(3) may send and/or receive the hub-selection messages and store an indication of the selected hub and the amount of time for which the selected device is to be act as the hub. The hub-selection components 912(1)-(3) may also set a timer for determining the amount of time for which the selected device is to act as a hub, or may otherwise determine when the time for the device to act as the hub has elapsed.

In some instances, messages sent by each device indicate a current battery level of the device (also referred to as a "battery level value"), a current connection strength to the WLAN of the device, information identifying the WLAN, information identifying the device, and/or the like. With this information, each hub-selection component 912(1)-(3) may determine the device that is to be selected as the communication hub. In some instances, the hub-selection components 912(1)-(3) may implement an algorithm that selects the device having the highest battery level remaining as the communication hub. In other instances, the components 912(1)-(3) may select the device having the highest connection strength as the communication hub. In still other instances, each component is configured to implement a cost function that selects the communication hub based on one or more weighted factors, such as current battery levels, connection strengths, and so forth. In other examples, one of the devices may be designated by the user as the hub and/or one of the device may include additional components and/or functionality and may be designed as the hub based at least in part on those additional components and/or functionality. For example, one device may include components that all for button arrangement determination, such as a gyroscope, accelerometer, GPS, RFID, or slots having sensors, while the other buttons include only communication means.

The accessory devices 108(1)-(3) and a primary device may couple with one another over a short-range wireless network and thus collectively forming a piconet 108. In the illustrated example, each of the devices comprise devices configured to communicate both with one another over a short-range connection as well as over a network 110. In some instances, meanwhile, while the primary device 102 may be configured to communicate over a short-range wireless network and over the network 110, the accessory devices 108(1)-(3) may be configured to communicate over multiple short-range wireless protocols (e.g., Bluetooth, BLE, etc.) while being incapable of communicating over the network 110. In these instances, the accessory devices 108(1)-(3) may select a communication hub that communicates with the other accessory devices over a low-power protocol while communicating with the primary device 102 over a higher-power protocol. The primary device 102 may then communicate these messages over the network 110.

Figure 10:
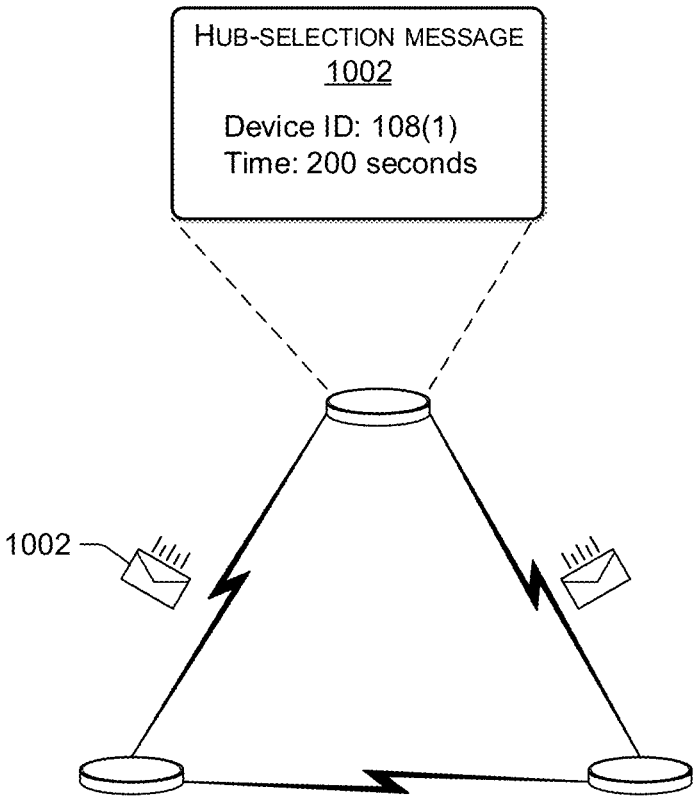
FIG. 10. illustrates an example hub-selection message that one of the devices in an environment may send to the other devices in response to the device determining that it is to act as the communication hub.

FIG. 10 illustrates an example hub-selection message that one of the devices in an environment may send to the other devices in response to the device determining that it is to act as the communication hub. While FIG. 10 illustrates the selected communication hub sending this message 1002, in this case the first accessory device 108(1), in other instances one or more other accessory devices may send this message 1002. For instance, one or more of the non-hub accessory devices may send this message and/or a remote system may send this message. As illustrated, the hub-selection message may indicate the device identification (DID) of the selected communication hub, in this example, the DID of the first accessory device 108(1), as well as the amount of time for which the selected accessory device is to act as the communication hub. In examples, this amount of time may be preconfigured and constant, while in other instances it may vary depending on battery life, the number of devices in the piconet, or the like. In response to receiving the hub-selection message 1002, the non-hub devices may store an indication of the DID of the communication hub as well as the amount of time for which the selected accessory device is to act as the communication hub. The devices may then again send out messages after expiration of the amount of time or just prior to expiration of this amount of time to determine if the hub communication device should change.

Figure 11:
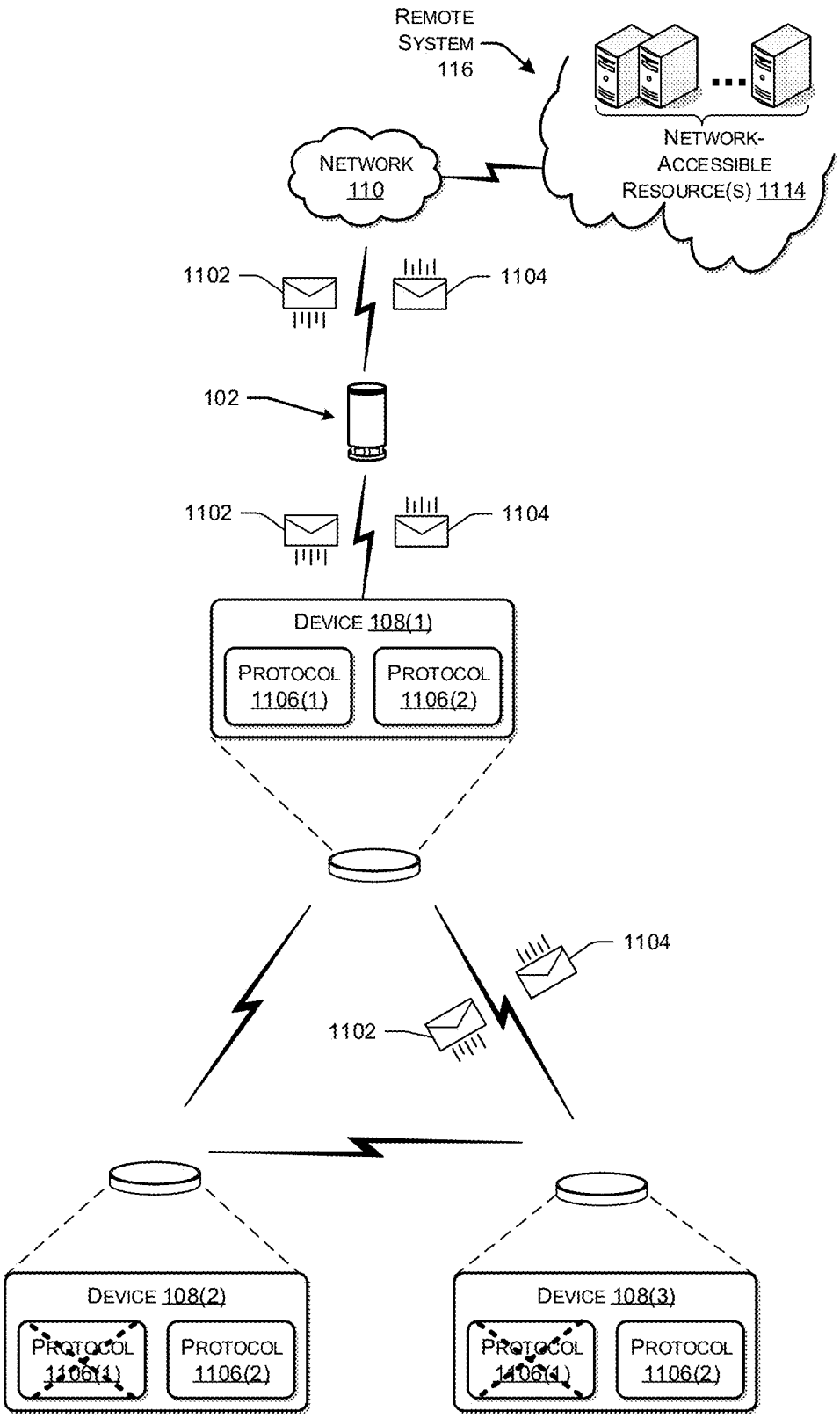
FIG. 11 illustrates example non-communication-hub devices communicating messages to an example communication hub, which in turn may communicate messages to another device in the environment, which in turn may communicate the messages to remote resources on behalf of the non-communication-hub devices.

FIG. 11 illustrates example non-communication-hub devices communicating messages to an example communication hub, which in turn may communicate messages to another device in the environment, which in turn may communicate the messages to remote resources on behalf of the non-communication-hub devices. In this example, each of the accessory devices 108(1)-(3) may be configured to communicate over two or more protocols, such as a first protocol 1106(1) and a second protocol 1106(2). In some instances, the first protocol 1106(1) may have greater range and/or fidelity than the second protocol 1106(2) but at a cost that depletes the battery of the respective device at a greater rate. That is, the first protocol 1106(1) may be deemed a higher-power protocol than the second protocol 1106(2), in that the first protocol results in greater power usage of the device battery. In examples, the higher-power protocol 1106(1) may comprise Bluetooth or another short-range wireless protocol, while the lower-power protocol 1106(2) may comprise Bluetooth Low Energy (BLE) or another short-range wireless protocol.

As illustrated, in this example the non-hub device 108(3) sends the message 1102 to the communication hub 108(1) using the second, lower-power protocol 1106(2). The communication hub 108(1) receives the message via the protocol 1106(2) and sends it along to the primary device 102 using the first, higher-power protocol 1106(1). The primary device 102, meanwhile, sends this message to the remote system over the network using, for example, WiFi or the like. The remote system then sends the response message 1104 to the primary device 102 over the network, and the primary device routes the message 1104 to the communication hub 108(1) via the first protocol 1106(1), which in turn routes the message 1104 to the accessory device 108(3) via the second protocol 1106(2).

Figure 12:
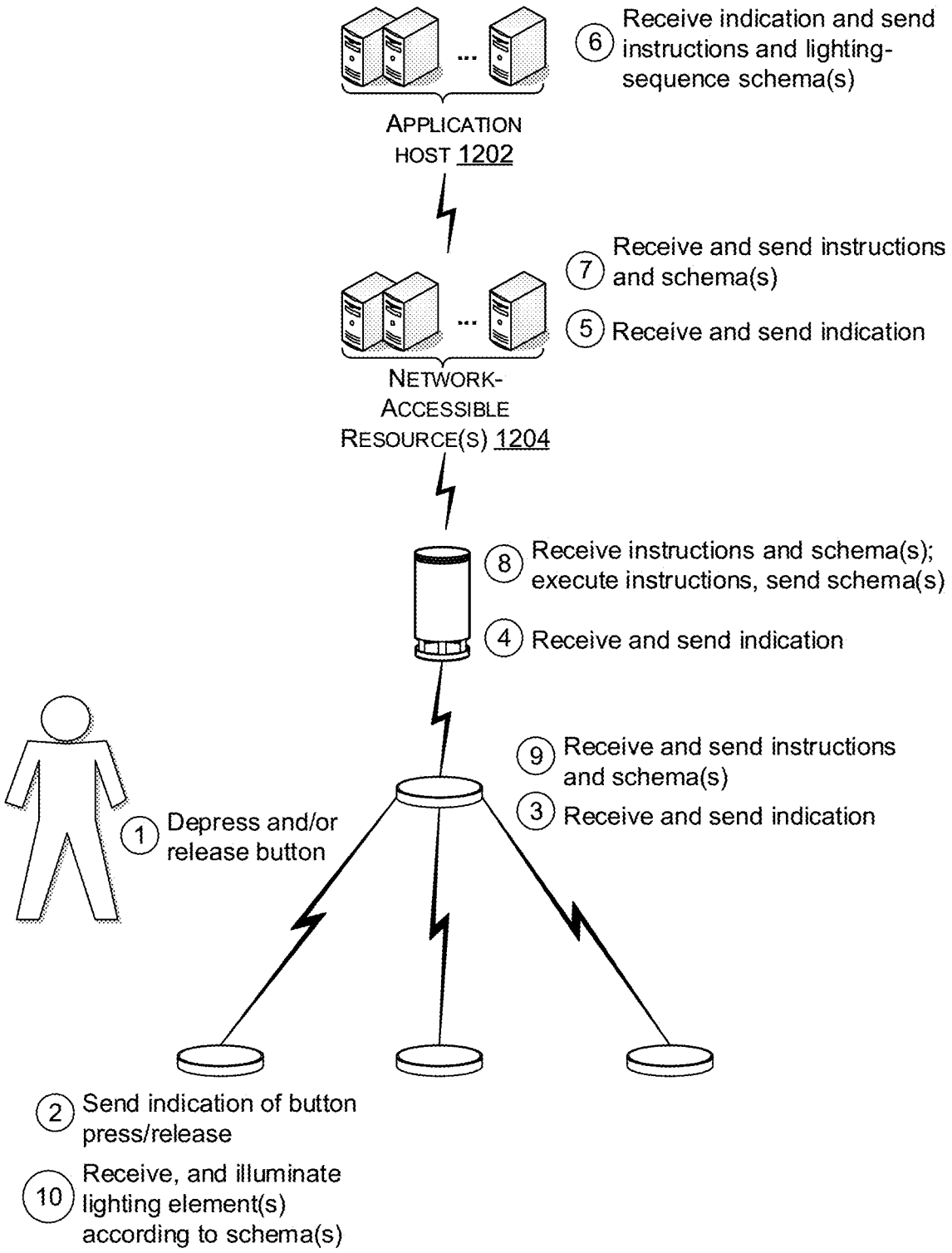
FIG. 12 illustrates an example scenario where a user interacts with an application via actuation of a button, as described herein.

FIG. 12 illustrates an example scenario where a user interacts with an application via actuation of a button, as described herein. That is, as opposed to the application host 1202 sending instructions to devices in an environment based on direct speech or other interaction with the primary device, in this example, the application host 1202 may send this information in response to the user interacting with the accessory device (e.g., pressing and/or releasing the actuatable button).

At "1," the user depresses and/or releases the actuatable button of a particular accessory device. At "2," the accessory device sends, such as over BLE, an indication of the button press/release to the accessory hub acting as the current communication hub for the accessory devices, unless the button was pressed on the current communication hub. At "3," the accessory device acting as the hub receives the indication of the button press/release and sends this indication, such as over Bluetooth, to the primary device, which receives this indication and sends this indication, such as over WiFi, to the network-accessible resources 114 of the remote system at "4."

At "5," the resources 1204 of the remote system receive the indication, identify the application whose content is being output on the primary device at the time of the button actuation, and send the indication of the button actuation to the application host 1202 executing the application at the time of the actuation. At "6," the application host 1202 receives the indication and sends instructions pertaining to execution of the application back to the resources 1204 of the remote system, which receives this information at "7" and sends it along to the primary device.

At "8," the primary device receives the instructions and, when applicable for the given application, executes the instructions. At "9," the accessory device acting as the hub receives the instructions and sends instructions corresponding to the button actuation to the appropriate devices. At "10," the appropriate accessory devices receive and store instructions and at the appropriate light, perform and/or cause performance of the action assigned to the accessory device.

Figure 13:
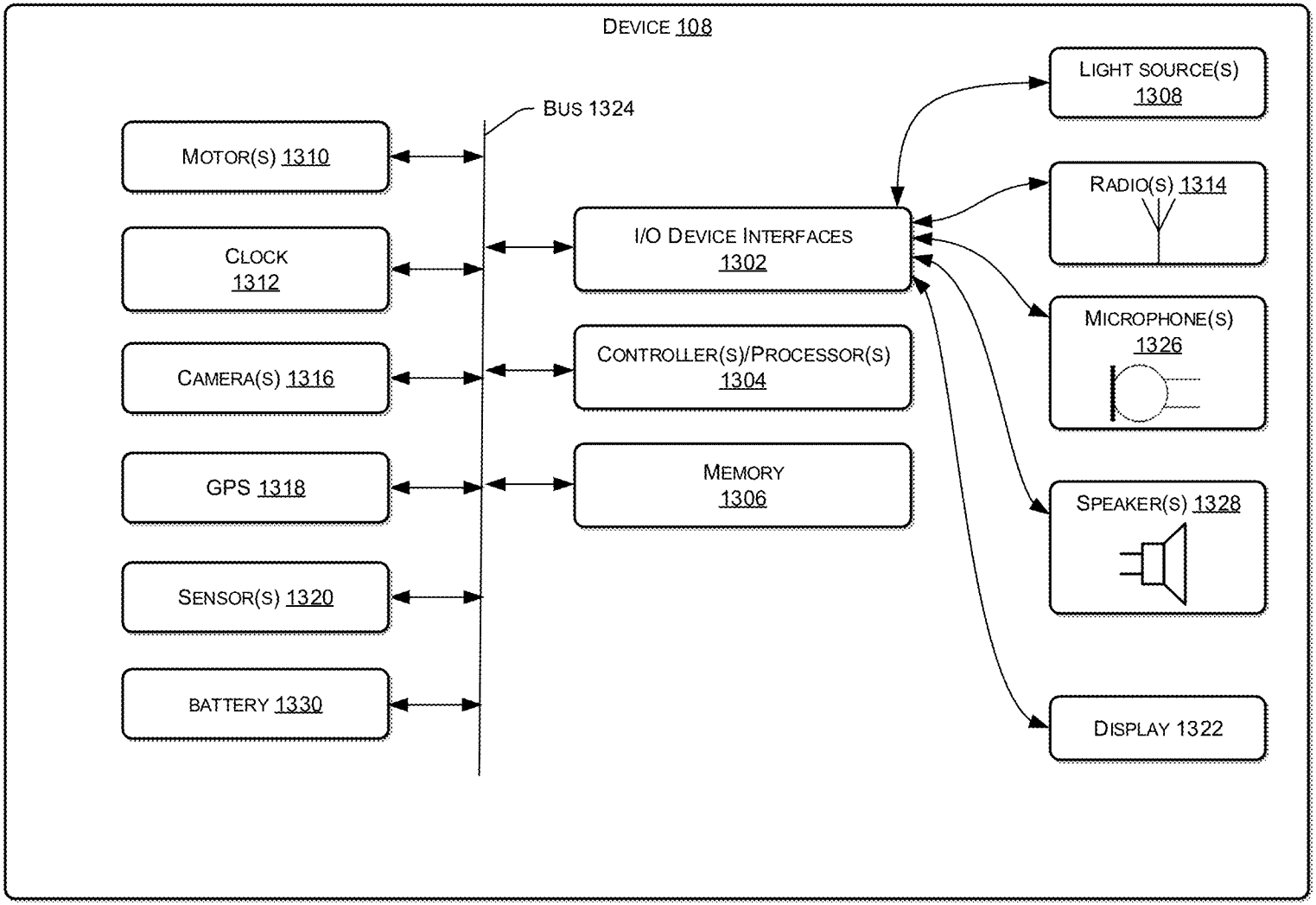
FIG. 13 illustrates a block diagram conceptually illustrating example components of an arrangeable devices to which one or more actions may be assigned.

FIG. 13 illustrates a block diagram conceptually illustrating example components of an accessory device, as described herein. As illustrated, the device 108 may include one or more I/O device interfaces 1302 and one or more processors 1304, which may each include a central processing unit (CPU) for processing data and computer-readable instructions. In addition, the device 108 may include memory 1306 for storing data and instructions of the respective device. The memory 1306 may individually include volatile random access memory (RAM), non-volatile read only memory (ROM), non-volatile magnetoresistive (MRAM) and/or other types of memory. The device 108 may also include a data storage component for storing data and controller/processor-executable instructions. Each data storage component may individually include one or more non-volatile storage types such as magnetic storage, optical storage, solid-state storage, etc. The device 108 may also connect to removable or external non-volatile memory and/or storage (such as a removable memory card, memory key drive, networked storage, etc.) through the respective input/output device interfaces 1302.

Computer instructions for operating the device 108 and its various components may be executed by the respective device's processor(s) 1304, using the memory 1306 as temporary "working" storage at runtime. The computer instructions of the device 104 may be stored in a non-transitory manner in non-volatile memory 1306, storage 1308, or an external device(s). Alternatively, some or all of the executable instructions may be embedded in hardware or firmware on the respective device 104 in addition to or instead of software.

As illustrated, the device 108 includes the input/output device interfaces 1302. A variety of components may be connected through the input/output device interfaces 1302. Additionally, the device 108 may include an address/data bus 1324 for conveying data among components of the respective device. Each component within the device 108 may also be directly connected to other components in addition to (or instead of) being connected to other components across the bus 1324.

The device 108 may also include a display 1322, which may include any suitable display technology, such as liquid crystal display (LCD), organic light emitting diode (OLED), electrophoretic, and so on. Furthermore, the processor(s) 1304 can comprise graphics processors for driving animation and video output on the associated displays 1322. Or, the device 108 may be "headless" and may primarily rely on spoken commands for input. As a way of indicating to a user that a connection between another device has been opened, the device 108 may be configured with one or more visual indicator, such as the light source(s) 1308 of the device 108, which may be in the form of an LED(s) or similar component, that may change color, flash, or otherwise provide visible light output. The device 108 may also include the input/output device interfaces 1302 that connect to a variety of components such as an audio output component such as a speaker 1328 for outputting audio (e.g., audio corresponding to audio content, a text-to-speech (TTS) response, etc.), a wired headset or a wireless headset or other component capable of outputting audio. A wired or a wireless audio and/or video port may allow for input/output of audio/video to/from the device 108. The device 108 may also include an audio capture component. The audio capture component may be, for example, a microphone 1326 or array of microphones, a wired headset or a wireless headset, etc. The microphone 1326 may be configured to capture audio. If an array of microphones is included, approximate distance to a sound's point of origin may be performed using acoustic localization based on time and amplitude differences between sounds captured by different microphones of the array. The device 108 may be configured to generate audio data corresponding to detected audio. The device 108 (using input/output device interfaces 1302, radio(s) 1314, etc.) may also be configured to transmit the audio data to the remote system for further processing or to process the data using internal components. In some arrangements, the device 108 may be similarly configured to generate and transmit audio data corresponding to audio detected by the microphone(s) 1326.

Via the radio(s) 1314, the input/output device interfaces 1302 may connect to one or more networks via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. A wired connection such as Ethernet may also be supported. Universal Serial Bus (USB) connections may also be supported. Power may be provided to the device 104 via wired connection to an external alternating current (AC) outlet, and/or via one or more onboard batteries 1322. The batteries 1322 may comprise any sort of electrochemical cells with external connections to power the device 108. For instance, the batteries 1322 may include alkaline batteries, disposable batteries, rechargeable batteries, lead-acid batteries, lithium-ion batteries, and/or the like. As described above, the batteries may drain with time and use and, thus, may at any point in time have a charge that is somewhere between fully charged (i.e., 100% of charge) and fully depleted or dead (i.e., 0% of charge).

The device 108 may further include a clock 1312, input devices such as a camera 1316, a GPS unit 1318, or one or more other sensors 1320, such as gyroscopes, accelerometers, and RFID components. These sensors may be used for various purposes, such as accelerometers for movement detection, temperature sensors, such as to issue warnings/notifications to users in the vicinity of the accessory, and other types of sensors 1318. The GPS 1318 receiver can be utilized for location determination of the device 108.

Figure 14:
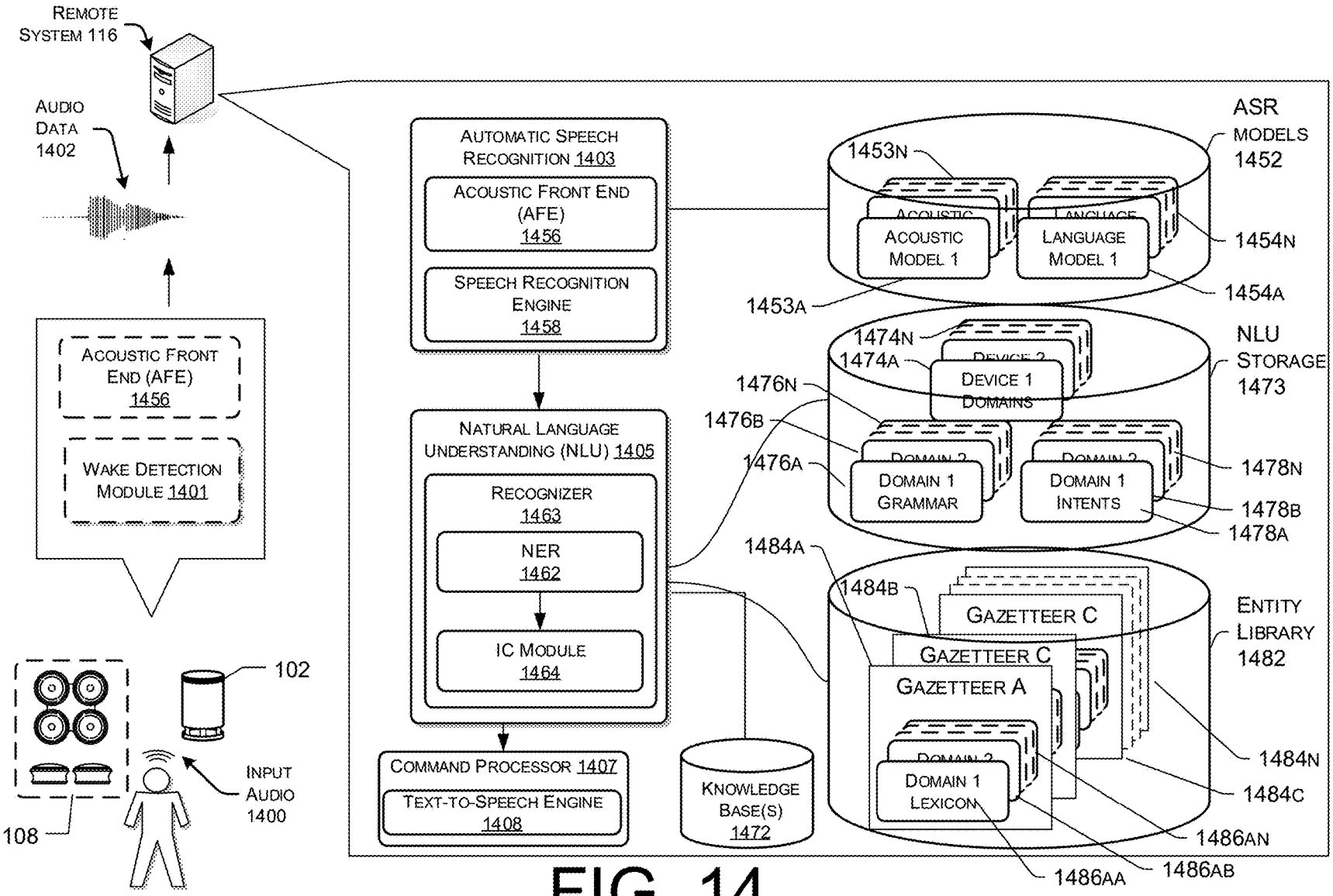
FIG. 14 illustrates a conceptual diagram of components of a speech processing system for processing audio data provided by one or more devices.

FIG. 14 illustrates a conceptual diagram of how a spoken utterance can be processed, allowing a system to capture and execute commands spoken by a user, such as spoken commands that may follow a wakeword, or trigger expression, (i.e., a predefined word or phrase for "waking" a device, causing the device to begin sending audio data to a remote system, such as system 116). The various components illustrated may be located on a same or different physical devices. Communication between various components illustrated in FIG. 14 may occur directly or across a network 110. An audio capture component, such as a microphone 144 of the user device 102, or another device, captures audio 1400 corresponding to a spoken utterance. The device 102 or 108, using a wakeword detection module 1401, then processes audio data corresponding to the audio 1400 to determine if a keyword (such as a wakeword) is detected in the audio data. Following detection of a wakeword, the device 102 or 108 sends audio data 1402 corresponding to the utterance to the remote system 116 that includes an ASR module 1403. The audio data 1402 may be output from an optional acoustic front end (AFE) 1456 located on the device prior to transmission. In other instances, the audio data 1402 may be in a different form for processing by a remote AFE 1456, such as the AFE 1456 located with the ASR module 1403 of the remote system 116.

The wakeword detection module 1401 works in conjunction with other components of the user device, for example a microphone to detect keywords in audio 1400. For example, the device may convert audio 1400 into audio data, and process the audio data with the wakeword detection module 1401 to determine whether human sound is detected, and if so, if the audio data comprising human sound matches an audio signature and/or model corresponding to a particular keyword.

The user device may use various techniques to determine whether audio data includes human sound. Some embodiments may apply voice activity detection (VAD) techniques. Such techniques may determine whether human sound is present in an audio input based on various quantitative aspects of the audio input, such as the spectral slope between one or more frames of the audio input; the energy levels of the audio input in one or more spectral bands; the signal-to-noise ratios of the audio input in one or more spectral bands; or other quantitative aspects. In other embodiments, the user device may implement a limited classifier configured to distinguish human sound from background noise. The classifier may be implemented by techniques such as linear classifiers, support vector machines, and decision trees. In still other embodiments, Hidden Markov Model (HMM) or Gaussian Mixture Model (GMM) techniques may be applied to compare the audio input to one or more acoustic models in human sound storage, which acoustic models may include models corresponding to human sound, noise (such as environmental noise or background noise), or silence. Still other techniques may be used to determine whether human sound is present in the audio input.

Once human sound is detected in the audio received by user device (or separately from human sound detection), the user device may use the wakeword detection module 1401 to perform wakeword detection to determine when a user intends to speak a command to the user device. This process may also be referred to as keyword detection, with the wakeword being a specific example of a keyword. Specifically, keyword detection may be performed without performing linguistic analysis, textual analysis or semantic analysis. Instead, incoming audio (or audio data) is analyzed to determine if specific characteristics of the audio match preconfigured acoustic waveforms, audio signatures, or other data to determine if the incoming audio "matches" stored audio data corresponding to a keyword.

Thus, the wakeword detection module 1401 may compare audio data to stored models or data to detect a wakeword. One approach for wakeword detection applies general large vocabulary continuous speech recognition (LVCSR) systems to decode the audio signals, with wakeword searching conducted in the resulting lattices or confusion networks. LVCSR decoding may require relatively high computational resources. Another approach for wakeword spotting builds hidden Markov models (HMM) for each key wakeword word and non-wakeword speech signals respectively. The non-wakeword speech includes other spoken words, background noise, etc. There can be one or more HMMs built to model the non-wakeword speech characteristics, which are named filler models. Viterbi decoding is used to search the best path in the decoding graph, and the decoding output is further processed to make the decision on keyword presence. This approach can be extended to include discriminative information by incorporating hybrid DNN-HMM decoding framework. In another embodiment, the wakeword spotting system may be built on deep neural network (DNN)/recursive neural network (RNN) structures directly, without HMM involved. Such a system may estimate the posteriors of wakewords with context information, either by stacking frames within a context window for DNN, or using RNN. Following-on posterior threshold tuning or smoothing is applied for decision making. Other techniques for wakeword detection, such as those known in the art, may also be used.

Once the wakeword is detected, the local device 102 may "wake" and begin transmitting audio data 1402 corresponding to input audio 1400 to the remote system 116 for speech processing. Audio data corresponding to that audio may be sent to remote system 116 for routing to a recipient device or may be sent to the remote system 116 for speech processing for interpretation of the included speech (either for purposes of enabling voice-communications and/or for purposes of executing a command in the speech). The audio data 1402 may include data corresponding to the wakeword, or the portion of the audio data corresponding to the wakeword may be removed by the local device 102 prior to sending. Further, a local device may "wake" upon detection of speech/spoken audio above a threshold, as described herein. Upon receipt by the remote system 116, an ASR module 1403 may convert the audio data 1402 into text. The ASR transcribes audio data into text data representing the words of the speech contained in the audio data 1402. The text data may then be used by other components for various purposes, such as executing system commands, inputting data, etc. A spoken utterance in the audio data is input to a processor configured to perform ASR which then interprets the utterance based on the similarity between the utterance and pre-established language models 1454 stored in an ASR model knowledge base (ASR Models Storage 1452). For example, the ASR process may compare the input audio data with models for sounds (e.g., subword units or phonemes) and sequences of sounds to identify words that match the sequence of sounds spoken in the utterance of the audio data.

The different ways a spoken utterance may be interpreted (i.e., the different hypotheses) may each be assigned a probability or a confidence score representing the likelihood that a particular set of words matches those spoken in the utterance. The confidence score may be based on a number of factors including, for example, the similarity of the sound in the utterance to models for language sounds (e.g., an acoustic model 1453 stored in an ASR Models Storage 1452), and the likelihood that a particular word that matches the sounds would be included in the sentence at the specific location (e.g., using a language or grammar model). Thus, each potential textual interpretation of the spoken utterance (hypothesis) is associated with a confidence score. Based on the considered factors and the assigned confidence score, the ASR process 1403 outputs the most likely text recognized in the audio data. The ASR process may also output multiple hypotheses in the form of a lattice or an N-best list with each hypothesis corresponding to a confidence score or other score (such as probability scores, etc.).

The device or devices performing the ASR processing may include an acoustic front end (AFE) 1456 and a speech recognition engine 1458. The acoustic front end (AFE) 1456 transforms the audio data from the microphone into data for processing by the speech recognition engine 1458. The speech recognition engine 1458 compares the speech recognition data with acoustic models 1453, language models 1454, and other data models and information for recognizing the speech conveyed in the audio data. The AFE 1456 may reduce noise in the audio data and divide the digitized audio data into frames representing time intervals for which the AFE 1456 determines a number of values, called features, representing the qualities of the audio data, along with a set of those values, called a feature vector, representing the features/qualities of the audio data within the frame. Many different features may be determined, as known in the art, and each feature represents some quality of the audio that may be useful for ASR processing. A number of approaches may be used by the AFE to process the audio data, such as mel-frequency cepstral coefficients (MFCCs), perceptual linear predictive (PLP) techniques, neural network feature vector techniques, linear discriminant analysis, semi-tied covariance matrices, or other approaches known to those of skill in the art.

The speech recognition engine 1458 may process the output from the AFE 1456 with reference to information stored in speech/model storage (1452). Alternatively, post front-end processed data (such as feature vectors) may be received by the device executing ASR processing from another source besides the internal AFE. For example, the user device may process audio data into feature vectors (for example using an on-device AFE 1456) and transmit that information to a server across a network for ASR processing. Feature vectors may arrive at the remote system 116 encoded, in which case they may be decoded prior to processing by the processor executing the speech recognition engine 1458.

The speech recognition engine 1458 attempts to match received feature vectors to language phonemes and words as known in the stored acoustic models 1453 and language models 1454. The speech recognition engine 1458 computes recognition scores for the feature vectors based on acoustic information and language information. The acoustic information is used to calculate an acoustic score representing a likelihood that the intended sound represented by a group of feature vectors matches a language phoneme. The language information is used to adjust the acoustic score by considering what sounds and/or words are used in context with each other, thereby improving the likelihood that the ASR process will output speech results that make sense grammatically. The specific models used may be general models or may be models corresponding to a particular domain, such as music, banking, etc.

The speech recognition engine 1458 may use a number of techniques to match feature vectors to phonemes, for example using Hidden Markov Models (HMMs) to determine probabilities that feature vectors may match phonemes. Sounds received may be represented as paths between states of the HMM and multiple paths may represent multiple possible text matches for the same sound.

Following ASR processing, the ASR results may be sent by the speech recognition engine 1458 to other processing components, which may be local to the device performing ASR and/or distributed across the network(s). For example, ASR results in the form of a single textual representation of the speech, an N-best list including multiple hypotheses and respective scores, lattice, etc. may be sent to the remote system 116, for natural language understanding (NLU) processing, such as conversion of the text into commands for execution, either by the user device, by the remote system 116, or by another device (such as a server running a specific application like a search engine, etc.).

The device performing NLU processing 1405 (e.g., server 116) may include various components, including potentially dedicated processor(s), memory, storage, etc. As shown in FIG. 14, an NLU component 1405 may include a recognizer 1463 that includes a named entity recognition (NER) module 1462 which is used to identify portions of query text that correspond to a named entity that may be recognizable by the system. A downstream process called named entity resolution links a text portion to a specific entity known to the system. To perform named entity resolution, the system may utilize gazetteer information (1484*a*-1484*n*) stored in entity library storage 1482. The gazetteer information may be used for entity resolution, for example matching ASR results with different entities (such as song titles, contact names, etc.) Gazetteers may be linked to users (for example a particular gazetteer may be associated with a specific user's music collection), may be linked to certain domains (such as shopping), or may be organized in a variety of other ways.

Generally, the NLU process takes textual input (such as processed from ASR 1403 based on the utterance input audio 1400) and attempts to make a semantic interpretation of the text. That is, the NLU process determines the meaning behind the text based on the individual words and then implements that meaning. NLU processing 1405 interprets a text string to derive an intent or a desired action from the user as well as the pertinent pieces of information in the text that allow a device (e.g., device 102) to complete that action. For example, if a spoken utterance is processed using ASR 1403 and outputs the text "play Jeopardy" the NLU process may determine that the user intended for the device to initiate a game of Jeopardy.

The NLU may process several textual inputs related to the same utterance. For example, if the ASR 1403 outputs N text segments (as part of an N-best list), the NLU may process all N outputs to obtain NLU results.

As will be discussed further below, the NLU process may be configured to parse and tag to annotate text as part of NLU processing. For example, for the text "play You're Welcome," "play" may be tagged as a command (to access a song and output corresponding audio) and "You're Welcome" may be tagged as a specific song to be played.

To correctly perform NLU processing of speech input, an NLU process 1405 may be configured to determine a "domain" of the utterance so as to determine and narrow down which services offered by the endpoint device (e.g., remote system 116 or the user device) may be relevant. For example, an endpoint device may offer services relating to interactions with a telephone service, a contact list service, a calendar/scheduling service, a music player service, etc. Words in a single text query may implicate more than one service, and some services may be functionally linked (e.g., both a telephone service and a calendar service may utilize data from the contact list).

The named entity recognition (NER) module 1462 receives a query in the form of ASR results and attempts to identify relevant grammars and lexical information that may be used to construe meaning. To do so, the NLU module 1405 may begin by identifying potential domains that may relate to the received query. The NLU storage 1473 includes a database of devices (1474*a*-1474*n*) identifying domains associated with specific devices. For example, the user device may be associated with domains for music, telephony, calendaring, contact lists, and device-specific communications, but not video. In addition, the entity library may include database entries about specific services on a specific device, either indexed by Device ID, User ID, or Household ID, or some other indicator.

In NLU processing, a domain may represent a discrete set of activities having a common theme, such as "shopping," "music," "calendaring," etc. As such, each domain may be associated with a particular recognizer 1463, language model and/or grammar database (1476*a*-1476*n*), a particular set of intents/actions (1478*a*-1478*n*), and a particular personalized lexicon (1486). Each gazetteer (1484*a*-1484*n*) may include domain-indexed lexical information associated with a particular user and/or device. For example, the Gazetteer A (1484*a*) includes domain-index lexical information 1486*aa* to 1486*an*. A user's contact-list lexical information might include the names of contacts. Since every user's contact list is presumably different, this personalized information improves entity resolution.

As noted above, in traditional NLU processing, a query may be processed applying the rules, models, and information applicable to each identified domain. For example, if a query potentially implicates both communications and, for example, music, the query may, substantially in parallel, be NLU processed using the grammar models and lexical information for communications, and will be processed using the grammar models and lexical information for music. The responses based on the query produced by each set of models is scored, with the overall highest ranked result from all applied domains ordinarily selected to be the correct result.

An intent classification (IC) module 1464 parses the query to determine an intent or intents for each identified domain, where the intent corresponds to the action to be performed that is responsive to the query. Each domain is associated with a database (1478*a*-1478*n*) of words linked to intents. For example, a music intent database may link words and phrases such as "quiet," "volume off;" and "mute" to a "mute" intent. A voice-message intent database, meanwhile, may link words and phrases such as "send a message," "send a voice message," "send the following," or the like. The IC module 1464 identifies potential intents for each identified domain by comparing words in the query to the words and phrases in the intents database 1478. In some instances, the determination of an intent by the IC module 1464 is performed using a set of rules or templates that are processed against the incoming text to identify a matching intent.

In order to generate a particular interpreted response, the NER 1462 applies the grammar models and lexical information associated with the respective domain to actually recognize a mention of one or more entities in the text of the query. In this manner, the NER 1462 identifies "slots" or values (i.e., particular words in query text) that may be needed for later command processing. Depending on the complexity of the NER 1462, it may also label each slot with a type of varying levels of specificity (such as noun, place, city, artist name, song name, or the like). Each grammar model 1476 includes the names of entities (i.e., nouns) commonly found in speech about the particular domain (i.e., generic terms), whereas the lexical information 1486 from the gazetteer 1484 is personalized to the user(s) and/or the device. For instance, a grammar model associated with the shopping domain may include a database of words commonly used when people discuss shopping.

The intents identified by the IC module 1464 are linked to domain-specific grammar frameworks (included in 1476) with "slots" or "fields" to be filled with values. Each slot/field corresponds to a portion of the query text that the system believes corresponds to an entity. To make resolution more flexible, these frameworks would ordinarily not be structured as sentences, but rather based on associating slots with grammatical tags. For example, if "play a song" is an identified intent, a grammar (1476) framework or frameworks may correspond to sentence structures such as "play the song {song title}" and/or "play {song title}."

For example, the NER module 1462 may parse the query to identify words as subject, object, verb, preposition, etc., based on grammar rules and/or models, prior to recognizing named entities. The identified verb may be used by the IC module 1464 to identify intent, which is then used by the NER module 1462 to identify frameworks. A framework for the intent of "play a song," meanwhile, may specify a list of slots/fields applicable to play the identified "song" and any object modifier (e.g., specifying a music collection from which the song should be accessed) or the like. The NER module 1462 then searches the corresponding fields in the domain-specific and personalized lexicon(s), attempting to match words and phrases in the query tagged as a grammatical object or object modifier with those identified in the database(s).

This process includes semantic tagging, which is the labeling of a word or combination of words according to their type/semantic meaning. Parsing may be performed using heuristic grammar rules, or an NER model may be constructed using techniques such as hidden Markov models, maximum entropy models, log linear models, conditional random fields (CRF), and the like.

The frameworks linked to the intent are then used to determine what database fields should be searched to determine the meaning of these phrases, such as searching a user's gazette for similarity with the framework slots. If the search of the gazetteer does not resolve the slot/field using gazetteer information, the NER module 1462 may search the database of generic words associated with the domain (in the knowledge base 1472). So, for instance, if the query was "play You're Welcome," after failing to determine which song titled "You're Welcome" should be played, the NER component 1462 may search the domain vocabulary for the phrase "You're Welcome." In the alternative, generic words may be checked before the gazetteer information, or both may be tried, potentially producing two different results.

The output data from the NLU processing (which may include tagged text, commands, etc.) may then be sent to a command processor 1407. The destination command processor 1407 may be determined based on the NLU output. For example, if the NLU output includes a command to send a message, the destination command processor 1407 may be a message sending application, such as one located on the user device or in a message sending appliance, configured to execute a message sending command. If the NLU output includes a search request, the destination command processor 1407 may include a search engine processor, such as one located on a search server, configured to execute a search command. After the appropriate command is generated based on the intent of the user, the command processor 1407 may provide some or all of this information to a text-to-speech (TTS) engine 1408. The TTS engine 1408 may then generate an actual audio file for outputting the audio data determined by the command processor 1407 (e.g., "playing your song," or "lip syncing to . . . "). After generating the file (or "audio data"), the TTS engine 1407 may provide this data back to the remote system 116.

The NLU operations of existing systems may take the form of a multi-domain architecture. Each domain (which may include a set of intents and entity slots that define a larger concept such as music, books etc. as well as components such as trained models, etc. used to perform various NLU operations such as NER, IC, or the like) may be constructed separately and made available to an NLU component 1405 during runtime operations where NLU operations are performed on text (such as text output from an ASR component 1403). Each domain may have specially configured components to perform various steps of the NLU operations.

For example, in a NLU system, the system may include a multi-domain architecture consisting of multiple domains for intents/commands executable by the system (or by other devices connected to the system), such as music, video, books, and information. The system may include a plurality of domain recognizers, where each domain may include its own recognizer 1463. Each recognizer may include various NLU components such as an NER component 1462, IC module 1464 and other components such as an entity resolver, or other components.

For example, a messaging domain recognizer 1463-A (Domain A) may have an NER component 1462-A that identifies what slots (i.e., portions of input text) may correspond to particular words relevant to that domain. The words may correspond to entities such as (for the messaging domain) a recipient. An NER component 1462 may use a machine learning model, such as a domain specific conditional random field (CRF) to both identify the portions corresponding to an entity as well as identify what type of entity corresponds to the text portion. The messaging domain recognizer 1463-A may also have its own intent classification (IC) component 1464-A that determines the intent of the text assuming that the text is within the proscribed domain. An IC component may use a model, such as a domain specific maximum entropy classifier to identify the intent of the text, where the intent is the action the user desires the system to perform. For this purpose, the remote system computing device 116 may include a model training component. The model training component may be used to train the classifier(s)/machine learning models discussed above.

As noted above, multiple devices may be employed in a single speech processing system. In such a multi-device system, each of the devices may include different components for performing different aspects of the speech processing. The multiple devices may include overlapping components. The components of the user device and the remote system 116, as illustrated herein are exemplary, and may be located in a stand-alone device or may be included, in whole or in part, as a component of a larger device or system, may be distributed across a network or multiple devices connected by a network, etc.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A method, comprising:

receiving an indication that a first button is to be associated with a first action to be performed by a device associated with at least one of the first button or a second button;

determining an arrangement of the first button and the second button with respect to a connector, the arrangement determined from first data received from the first button and second data received from the second button indicating a first location that the first button has been placed with respect to the connector and a second location that the second button has been placed with respect to the connector;

associating, based at least in part on the arrangement, the first button with the first action such that the first button, when actuated, causes the device to perform the first action; and associating, based at least in part on the arrangement, the second button with a second action such that the second button, when actuated, causes the device to perform the second action.

2. The method of claim 1, wherein:

the first data indicates that a first portion of the connector has received at least a portion of the first button; and the second data indicates that a second portion of the connector has received at least a portion of the second button.

3. The method of claim 1, further comprising:

determining that the first location is within a threshold distance of the second location; and associating a third action with at least one of the first button or the second button based at least in part on the first location being within the threshold distance of the second location.

4. The method of claim 1, wherein the first data is associated with the first location of the first button and the second data is associated with the second location of the second button.

5. The method of claim 1, wherein the indication comprises a first indication, the arrangement comprises a first arrangement, and further comprising:

receiving a second indication that at least one of the first button or the second button has been enabled, the second indication received after a threshold amount of time from determining the first arrangement;

determining, based at least in part on receiving the second indication after the threshold amount of time, a second arrangement of the first button and the second button;

associating the first button with a third action based at least in part on the second arrangement; and associating the second button with a fourth action based at least in part on the second arrangement.

6. The method of claim 1, wherein the indication comprises a first indication, the arrangement comprises a first arrangement, and further comprising:

receiving a second indication that at least one of the first button or the second button has been enabled;

receiving motion data from a motion sensor associated with at least one of the first button or the second button;

determining, based at least in part on the motion data, that the first arrangement has changed;

determining, based at least in part on determining that the first arrangement has changed, a second arrangement of the first button and the second button;

associating the first button with a third action based at least in part on the second arrangement; and associating the second button with a fourth action based at least in part on the second arrangement.

7. The method of claim 1, wherein determining the arrangement comprises determining the arrangement based at least in part on an application being utilized by at least one of the first button, the second button, or the device.

8. The method of claim 1, wherein determining the arrangement comprises determining the arrangement based at least in part on a first magnetic field associated with the first button and a second magnetic field associated with the second button.

9. A system, comprising:

one or more processors; and computer-readable media storing computer executable instructions that, when executed by the one or more processors, cause the one or more processors to perform operations comprising:

receiving an indication that a first button is to be associated with a first action to be performed by a device associated with at least one of the first button or a second button;

determining an arrangement of the first button and the second button with respect to a connector, the arrangement determined from first data received from the first button and second data received from the second button indicating a first location that the first button has been placed with respect to the connector and a second location that the second button has been placed with respect to the connector;

associating, based at least in part on the arrangement, the first button with the first action such that the first button, when actuated, causes the device to perform the first action; and associating, based at least in part on the arrangement, the second button with a second action such that the second button, when actuated, causes the device to perform the second action.

10. The system of claim 9, wherein the indication comprises a first indication, the first button comprises first light elements disposed around a first perimeter of the first button, the second button comprises second light elements disposed around a second perimeter of the second button, and the operations further comprising:

causing a first light element of the first light elements to emit first light;

causing a second light element of the second light elements to emit second light;

causing output of audio representing an instruction, the audio directing a user to orient the first button and the second button such that the first light element is proximate to the second light element;

receiving a second indication that the first button and the second button have been oriented; and wherein determining the arrangement comprises determining the arrangement based at least in part on receiving the second indication.

11. The system of claim 9, wherein determining the arrangement comprises determining the arrangement based at least in part on a first magnetic field associated with the first button and a second magnetic field associated with the second button.

12. The system of claim 9, wherein:

the first data indicates that the first button is disposed at a first location relative to the connector; and the second data indicates that the second button is disposed at a second location relative to the connector.

13. The system of claim 9, wherein the first button comprises first slots, the second button comprises second slots, and wherein:

the first data indicates that a first prong of the connector has been received by a first slot of the first slots; and second data indicates that a second prong of the connector has been received by a second slot of the second slots.

14. The system of claim 9, wherein determining the arrangement comprises determining the arrangement based at least in part on an application being utilized by at least one of the first button, the second button, or a device associated with at least one of the first button or the second button.

15. The system of claim 9, the operations further comprising:

receiving third data indicating that the first button has been actuated;

causing display, via a device associated with the first button, of a list of indicators, each indicator representing an action;

receiving a first selection of the first action;

receiving fourth data indicating that the second button has been actuated;

causing display, via the device, of the list;

receiving a second selection of the second action; and wherein determining the arrangement comprises determining the arrangement based at least in part on the first selection and the second selection.

16. The system of claim 9, the operations further comprising:

receiving, from the first button, a first signal indicating that the first button is coupled to a first slot of the connector;

receiving, from the second button, a second signal indicating that the second button is coupled to a second slot of the connector; and wherein determining the arrangement comprises determining the arrangement based at least in part on the first signal and the second signal.

17. A system, comprising:

one or more processors; and computer-readable media storing computer executable instructions that, when executed by the one or more processors, cause the one or more processors to perform operations comprising:

receiving an indication that a first button is to be associated with a first action to be performed by a device associated with at least one of the first button or a second button;

determining an arrangement of the first button and the second button with respect to a connector, the arrangement determined from:

first data received from the first button, the first data indicating a first location that the first button has been placed with respect to the connector; and second data received from the second button, the second data indicating a second location that the second button has been placed with respect to the connector;

associating, based at least in part on the arrangement, the first button with the first action such that the first button, when actuated, causes the device to perform the first action; and associating, based at least in part on the arrangement, the second button with a second action such that the second button, when actuated, causes the device to perform the second action.

18. The system of claim 17, the operations further comprising:

determining that the first location is within a threshold distance of the second location; and associating a third action with at least one of the first button or the second button based at least in part on the first location being within the threshold distance of the second location.

19. The system of claim 17, wherein the indication comprises a first indication, the arrangement comprises a first arrangement, and further comprising:

receiving a second indication that at least one of the first button or the second button has been enabled, the second indication received after a threshold amount of time from determining the first arrangement;

determining, based at least in part on receiving the second indication after the threshold amount of time, a second arrangement of the first button and the second button;

associating the first button with a third action based at least in part on the second arrangement; and associating the second button with a fourth action based at least in part on the second arrangement.

20. The system of claim 17, wherein the arrangement comprises a first arrangement, and further comprising:

receiving motion data from a motion sensor associated with at least one of the first button or the second button;

determining, based at least in part on the motion data, that the first arrangement has changed;

determining, based at least in part on determining that the first arrangement has changed, a second arrangement of the first button and the second button;

associating the first button with a third action based at least in part on the second arrangement; and associating the second button with a fourth action based at least in part on the second arrangement.

* * * * *